US006582243B2

(12) United States Patent
Endo et al.

(10) Patent No.: US 6,582,243 B2
(45) **Date of Patent: *Jun. 24, 2003**

(54) CONNECTOR PROVIDED WITH LOCK ENSURING MECHANISM

(75) Inventors: Tomomi Endo, Shizuoka (JP); Eiji Fukuda, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/960,342

(22) Filed: Sep. 24, 2001

(65) Prior Publication Data

US 2002/0045380 A1 Apr. 18, 2002

(30) Foreign Application Priority Data

Sep. 22, 2000 (JP) ..... 2000-289137
Aug. 17, 2001 (JP) ..... 2001-248222

(51) Int. Cl.[7] ..... H01R 13/627
(52) U.S. Cl. ..... 439/352
(58) Field of Search ..... 439/352, 489, 439/372, 329, 310, 488, 923, 429, 159, 188, 357, 358, 595

(56) References Cited

U.S. PATENT DOCUMENTS 5,605,472 A * 2/1997 Sakai et al. ..... 439/489
6,461,186 B1 * 10/2002 Endo ..... 439/352

FOREIGN PATENT DOCUMENTS

| | | |
|---|---|---|
| EP | 0 655 807 A2 | 5/1995 |
| JP | 7-192808 | 7/1995 |
| JP | 9-219255 | 8/1997 |

* cited by examiner

*Primary Examiner*—P. Austin Bradley
*Assistant Examiner*—Phuongchi Nguyen
(74) *Attorney, Agent, or Firm*—Sughrue Mion, PLLC

(57) ABSTRACT

In order to ensure whether a first housing and a second housing which constitute a connector are completely engaged with each other, a locking member is provided in the first housing, and a locking arm is provided in the second housing. A lock ensuring member is provided so as to be supported by the locking arm movably in the extending direction of the locking arm between a first position closer to the first housing and a second position farther from the first housing, and such that the locking ensuring member is moved toward the second position when the first housing and the second housing are completely engaged with each other. An engaging operation of the housings is started in a state that the lock ensuring member is placed at the first position. The lock ensuring member is moved toward the first position after the engaging operation is completed.

12 Claims, 19 Drawing Sheets

CONNECTOR PROVIDED WITH LOCK ENSURING MECHANISM

BACKGROUND OF THE INVENTION

The present invention relates to a connector provided with a lock ensuring mechanism which is used for connection of electric wires and the like.

A wire harness used in a moving body such as an automobile has connectors which are each obtained by connecting a male-type connector housing (hereafter referred to as a male housing) and a female-type connector housing (hereafter referred to as a female housing). Terminals fittings with electric wires are accommodated in the male housing and the female housing.

In such a connector in which the male housing and the female housing are connected to each other, various ensuring mechanisms have hitherto been proposed to ascertain whether the male housing and the female housing have been completely connected or are in a semiengaged state. As the connector having the just-mentioned ensuring mechanism, a connector disclosed in, for example, Japanese Patent Publication No. 7-192808A shown in FIGS. 7 to 10 is known.

As illustrated in FIG. 21, a connector 101 having the aforementioned lock ensuring mechanism is provided with a female housing 102, a male housing 103, and a lock ensuring member 104. The female housing 102 has a main body 110 for accommodating a plurality of terminal fittings and a hood portion 111 for receiving the male housing 103 and is formed in a box shape.

A locking hole 105 is formed on an outer wall located on the upper side in the drawing among a plurality of outer walls for forming the hood portion 111. This locking hole 105 extends through the outer wall. In addition, a pair of releasing rods 113 extending from the main body 110 toward an opening of the hood portion 111 are provided inside the hood portion 111. Each of the releasing rods 113 has a projection 114 at its free end. A tapered face 115 is formed on an upper face of each projection 114.

The male housing 103 has a main body 116 for accommodating a plurality of terminal fittings and a locking arm 117. The locking arm 117 is formed in the shape of a strip, and one end portion thereof is integral with an outer wall of the main body 116. The other end portion of the locking arm 117 is a free end portion so that the locking arm is held by the main body 116 in a cantilevered manner. It should be noted that the fixed end portion is located in the vicinity of the female housing 102 when the female housing 102 and the male housing 103 are engaged with each other. The longitudinal direction of the locking arm 117 extends in the direction in which the housings 102 and 103 approach each other when the housings 102 and 103 are engaged with each other (hereinafter, this direction will be referred as an engagement direction).

The locking arm 117 is provided with a locking projection 118 at its widthwise central portion, and is provided with a detecting portion 119 at its other end portion. The locking projection 118 projects from an outer face of the locking arm 117 outwardly of the male housing 103. The locking projection 118 is to be engaged with the locking hole 105.

The detecting portion 119 projects from the outer face of the locking arm 117 outwardly of the male housing 103, The detecting portion 119 has an inclined face 120 on a side of which does not face the female housing 102. The inclined face 120 extends in the engagement direction, so as to form an acute angle with the direction of extension of the locking arm 117. In addition, an engaging projection 121 is provided at the fixed end portion of the locking arm 117. The engaging projection 121 projects outwardly from the fixed end portion.

Further, the male housing 103 has a pair of protective walls 122. These protective walls 122 are respectively provided uprightly on the outer wall of the main body 116, and are parallel to the locking arm 117. The protective walls 122 are respectively disposed on both sides of the locking arm 117 and distanced from the locking arm 117.

When the female housing 102 and the male housing 103 are engaged, the locking projection 118 of the locking arm 107 is engaged with the locking hole 105 so that the engagement between the female and male housings 102 and 103 is locked.

The lock ensuring member 104 has an inverse U-shaped proximal portion and a pair of flexible retaining pieces 124. One end portion of each of flexible retaining pieces 124 is integral with the proximal portion 123 so that the flexible retaining pieces 124 are respectively cantilevered by the proximal portion 123. A tapered face 126 is formed on a lower face continuing to each free end 125 of the flexible retaining piece 124.

The flexible retaining pieces 124 are respectively provided with detecting projections 127. Each detecting projection 127 is provided between the free end 125 of the flexible retaining piece 124 and the proximal portion 123. The lock ensuring member 104 is attached to the male housing 103 such that the locking arm 117 is sandwiched between the pair of flexible retaining pieces 124, and the pair of flexible retaining pieces 124 are positioned between the pair of protective walls 122.

As for the connector 101 constructed as described above, the lock ensuring member 104 is attached to the male housing 103 in advance in a state in which the free ends 125 of the flexible retaining pieces 124 respectively abut against the engaging projections 121, as shown in FIG. 22. At this state, the male housing 103 and the female housing 102 are engaged with each other. When the locking projection 118 is engaged with the locking hole 105, the lock ensuring member 104 is pressed toward the female housing 102. Then, as shown in FIG. 23, the free ends 125 tend to be displaced along the tapered faces 126.

When the lock ensuring member 104 is further pressed toward the female housing 102, the flexible retaining pieces 124 are retained by the engaging projections 121, as shown in FIG. 24. In addition, the detecting projections 127 is positioned between the detecting portion 119 and an edge portion of the outer wall of the female housing 102 for forming the hood portion 111. The detecting projections 127 are engaged with the detecting portion 119.

Meanwhile, when the connector 101 is in a state in which the locking projection 118 is not engaged with the locking hole 105, i.e., in a state in which the male housing 103 and the female housing 102 are in a state of being semiengaged with each other, the free end portion of the locking arm 117 is urged toward the male housing 103. For this reason, even if the lock ensuring member 104 is pressed toward the female housing 102, the lock ensuring member 104 abuts against the inclined face 120 of the detecting portion 119, so that the lock ensuring member 104 cannot be pressed toward the female housing 102.

Thus, in the case of the connector 101 having the above-described related lock ensuring mechanism, whether or not the female housing 102 and the male housing 103 are completely engaged with each other is determined on the basis of whether or not the lock ensuring member 104 can be pressed toward the female housing 102.

Moreover, some connectors provided with a lock ensuring mechanism comprises a female housing, a male housing and a, lock ensuring member which is slidably supported on one of the female housing and the male housing. One of the housings is provided with a locking arm which is once deformed elastically when the male housing is fitted in the female housing. The other housing is provided with an engaging portion to be engaged with the locking arm. The lock ensuring member slides between a locked position in which the elastic deformation of the locking arm is restricted and an unlocked position in which the elastic deformation of the locking arm is allowed.

The lock ensuring member is maintained in the unlocked position until the male housing is fitted in the female housing. When the male housing is completely fitted in the female housing, the lock ensuring member can freely slide between the locked position and the unlocked position. Consequently, the lock ensuring member is maintained in the locked position so that the engagement of the male housing in the female housing is not released. Moreover, when the male housing is incompletely fitted in the female housing, the lock ensuring member cannot be displaced to the locked position but is maintained in the unlocked position. Thus, it can be recognized that the male housing is completely (reliably) fitted in the female housing or not depending on whether or not the lock ensuring member can be displaced to the locked position.

With the connector 101 having the related lock ensuring mechanism, the lock ensuring member 104 is moved toward the female housing 102 after engagement between the female housing 102 and the male housing 103. For this reason, it has been necessary to keep the free end portion of the lock ensuring member 104 projecting outwardly of the outer wall of the male housing 103 before the engagement between the housings 102 and 103.

Consequently, when the aforesaid wire harness is manufactured, there has been the risk that the other end portion of the above-described lock ensuring member 104 comes into contact with or becomes caught by various manufacturing devices for manufacturing the wire harness. In a worst case, there has been the risk of particularly the free end portion of the lock ensuring member 104 becoming broken.

In particular, when terminal fittings 140 are inserted into the main body 116 of the male housing 103 with the lock ensuring member 104 attached thereto, chucks 41 such as those shown in FIG. 25B are used. Each chuck 41 has a pair of clamping pieces 42 which are capable of clamping the terminal fitting 140 therebetween. In this case, as shown in FIG. 25A, the other end portion of the lock ensuring member 104 and the chuck 41 interfere with each other. For this reason, it becomes difficult to insert the terminal fittings 140 into the main body 116 of the male housing 103 by using the chucks 41.

In the connector having the lock ensuring member, moreover, when the male housing is completely engaged with the female housing, the lock ensuring member can freely slide between the locked position and the unlocked position. Furthermore, the lock ensuring member is maintained in the unlocked position until the male housing is engaged with the female housing. Consequently, an operator to assemble the connector forgets to move the lock ensuring member to the locked position after the male housing is engaged with the female housing. For this reason, there is a risk that the male housing might accidentally slip out of the female housing during the delivery of an assembled connector.

Furthermore, when the male housing is completely engaged with the female housing, the lock ensuring member can freely slide between the locked position and the unlocked position. For this reason, there is also a risk that the lock ensuring member might be displaced from the locked position to the unlocked position and the male housing might accidentally slip out of the female housing during the delivery of the assembled connector.

SUMMARY OF THE INVENTION

It is a first object of the invention to provide a connector provided with a lock ensuring mechanism and a lock ensuring method for the connector which can prevent a male housing from accidentally slipping out of a female housing after the engagement and.

It is a second object of the invention to provide a connector provided with a lock ensuring mechanism which does not disturb the manufacture of a wire harness and can prevent the wire harness from being broken during the manufacture.

It is a third object of the invention to provide a connector housing which can be prevented from accidentally slipping out of the other connector housing after the engagement.

In order to achieve the first object, according to the invention, there is provided a method of ensuring whether a first housing and a second housing which constitute a connector are completely engaged with each other, comprising the steps of:

providing a locking member in the first housing;

providing a locking arm in the second housing so as to be once deformed to be engaged with the locking member to engage the first housing and the second housing;

providing a lock ensuring member so as to be supported by the locking arm movably in the extending direction of the locking arm between a first position closer to the first housing and a second position farther from the first housing, so as to restrict the deformation of the locking arm at the first position, so as to allow the deformation of the locking arm at the second position, and such that the locking ensuring member is moved toward the second position when the first housing and the second housing are completely engaged with each other;

starting an engaging operation of the first housing and the second housing in a state that the lock ensuring member is placed at the first position; and moving the lock ensuring member toward the first position after the engaging operation is completed.

In order to achieve the first object, according to the invention, there is also provided A connector for electrically connecting a first terminal fitting and a second terminal fitting, comprising:

a first housing, formed with a first chamber for accommodating the first terminal fitting therein;

a second housing, formed with a second chamber for accommodating the second terminal fitting therein;

a locking member, provided in the first housing;

a locking arm, extended from an outer face of the second housing in an extending direction of the second chamber, the locking arm being deformable in a direction perpendicular to the extending direction of the second chamber; and a lock ensuring member, supported by the locking arm movably in the extending direction of the second chamber between a first position closer to the first housing and a second position farther from the first housing, the lock ensuring member restricting the deformation of the locking arm at the first position, and allowing the deformation of the locking arm at the second position, wherein the locking arm is once deformed when the locking arm is engaged with the locking member to engage the first housing and the second housing; and wherein the lock ensuring member is moved toward the second position until the locking arm is engaged with the locking member.

In the above configurations, when the first housing is to be engaged with the second housing, the lock ensuring member is displaced from the first position to the second position. Accordingly, since an operator can easily recognize the lock ensuring member, the operator hardly forgets to displace the lock ensuring member toward the first position and the operator can easily recognize whether the first housing and the second housing are completely engaged with each other. Therefore, it is possible to reliably prevent the first housing and the second housing from accidentally slipping off after the engagement.

In order to achieve the first and the second objects, it is preferable that one end portion of the lock ensuring member which is away from the first housing is not protruded from an outer face of the second housing, when the lock ensuring member is placed at the second position.

In this configuration, it is possible to prevent the first housing and the second housing from accidentally slipping off after the engagement, and furthermore, to prevent the disturbance of the manufacture of a wire harness and to prevent a breakage.

In order to achieve the first and the second objects, it is preferable that the locking arm includes a locking projection protruded in an outward direction of the second housing and the lock ensuring member includes: a release stopper; an abutment face; and a locking recess. In this case, the locking projection is engaged with the release stopper of the lock ensuring member or the locking member of the first housing. The abutment face is abutted against the first housing when the locking projection is engaged with the locking member. The locking projection is entered into the locking recess when the lock ensuring member is moved toward the second position. At least one of the lock ensuring member and the locking arm includes a guide face which displaces the release stopper so as to be disengaged from the locking projection, when the first housing and the second housing approach in a state that the locking projection is entered into the locking recess.

In this configuration, the guide face displaces the lock ensuring member in such a direction as to go away from the locking projection interlockingly with the operation for engaging the housings with each other. At this time, the abutment face is abutted against the first housing, and the lock ensuring member is moved toward the second position so that the lock ensuring member is displaced in such a direction as to go away from the locking projection, that is, in such a direction as to go away from the locking member. Therefore, the lock ensuring member does not disturb the engagement of the locking projection with the locking member.

Accordingly, it is possible to prevent the first housing and the second housing from accidentally slipping off after the engagement, to prevent the disturbance of the manufacture of a wire harness and to prevent a breakage, and furthermore, to reliably fit the housings each other.

In order to achieve the first and the second objects, it is preferable that the second housing includes a restricting projection which is abutted against the lock ensuring member such that the release stopper is disengaged from the locking projection, when the locking arm is engaged with the locking member.

In this configuration, the restricting projection prevents the release stopper of the lock ensuring member from being disengaged from the locking arm after the locking arm is engaged with the locking member. Accordingly, it is possible to prevent the first housing and the second housing from accidentally slipping off after the engagement, to prevent the disturbance of the manufacture of a wire harness and to prevent a breakage, and furthermore, to reliably prevent the fitted housings from being accidentally separated from each other.

In order to achieve the first and the second objects, it is preferable that the second housing includes a stopper which delimits the movable range of the lock ensuring member toward the first housing.

In this configuration, it is possible to prevent the lock ensuring member from slipping out of the second housing before the engaging operation. Therefore, it is possible to prevent the first housing and the second housing from accidentally slipping off after the engagement, to prevent the disturbance of the manufacture of a wire harness and to prevent a breakage, and furthermore, to reliably fit the housings each other.

In order to achieve the first and the second objects, it is preferable that the stopper is brought into contact with a first portion of the lock ensuring member when the locking projection is engaged with the release stopper. In this case, a dimension between the stopper and a first outer face of the second housing which is most distant from the first housing is not less than a dimension obtained by adding a dimension between the first portion of the lock ensuring member and the first outer face of the second housing and a dimension in which the lock ensuring member moves toward the second position when the first housing and the second housing are engaged.

In this configuration, the end of the lock ensuring member which is provided apart from one of the housings can be more reliably prevented from being protruded from the outer face of the first housing. Therefore, it is possible to prevent the first housing and the second housing from accidentally slipping off after the engagement, and furthermore, to prevent the disturbance of the manufacture of a wire harness and to prevent a breakage.

In order to achieve the third object, it is preferable that one end portion of the lock ensuring member which is away from the first housing is protruded from an outer face of the second housing, when the lock ensuring member is placed at the second position.

In this configuration, an operator can easily recognize the lock ensuring member. Therefore, the operator hardly forgets to displace the lock ensuring member toward the first position. Accordingly, it is possible to reliably prevent the first housing and the second housing from accidentally slipping off after the engagement.

Moreover, the locking arm is easily deformed elastically through the lock ensuring member so that the locking arm can easily be disengaged from the locking member. Accordingly, the first housing and the second housing can easily be removed from each other.

In order to achieve the third object, according to the invention, there is provided a connector for electrically connecting a first terminal fitting and a second terminal fitting, comprising:

a first housing, formed with a first chamber for accommodating the first terminal fitting therein;

a second housing, formed with a second chamber for accommodating the second terminal fitting therein;

a locking member, provided in the first housing;

a locking arm, extended from an outer face of the second housing in an extending direction of the second chamber, the locking arm being deformable in a direction perpendicular to the extending direction of the first chamber; and a lock ensuring member, supported by the locking arm movably in the extending direction of the second chamber between a first position closer to the first housing and a second position farther from the first housing, the lock ensuring member restricting the deformation of the locking arm at the first position, and allowing the deformation of the locking arm at the second position; and a position retainer, which retains the lock ensuring member at either one of the first position and the second position, wherein the locking arm is once deformed when the locking arm is engaged with the locking member to engage the first housing and the second housing; and wherein the lock ensuring member is moved toward the second position when the first housing and the second housing are engaged with each other in a state that the lock ensuring member is placed in the first position.

In this configuration, an operator can easily recognize the lock ensuring member. Therefore, the operator hardly forgets to displace the lock ensuring member toward the first position. Accordingly, it is possible to reliably prevent the accidental slip-off of the housings after the engagement.

Moreover, since the position retainer holds the position of the lock ensuring member, the lock ensuring member displaced to the first position can be prevented from being displaced to the second position after the engagement. Accordingly, it is possible to more reliably prevent the accidental slip-off of the housings after the engagement.

In order to achieve the second and the third objects, it is preferable that one end portion of the lock ensuring member which is away from the first housing is not protruded from an outer face of the second housing, when the lock ensuring member is placed at the second position.

In this configuration, it is possible to prevent the slip-off from the first housing after the engagement, and furthermore, to prevent the disturbance of the manufacture of a wire harness and to prevent a breakage.

In order to achieve the third object, it is preferable that one end portion of the lock ensuring member which is away from the first housing is protruded from an outer face of the second housing, when the lock ensuring member is placed at the second position.

In this configuration, an operator can easily recognize the lock ensuring member. Therefore, the operator hardly forgets to displace the lock ensuring member toward the first position. Accordingly, it is possible to reliably prevent the accidental slip-off from the first housing after the engagement.

Moreover, since the end of the lock ensuring member is protruded from the second housing, the locking arm is easily deformed elastically through the lock ensuring member so that the locking arm can easily be disengaged from the locking member. Accordingly, it is easy to carry out the removal from the first housing.

In order to achieve the third object, it is preferable that the lock ensuring member includes a projection which restricts the deformation of the locking arm when the first housing and the second housing are engaged with each other in a state that the lock ensuring member is placed in the first position.

In this configuration, since the elastic deformation of the locking arm is restricted when the lock ensuring member is placed in the first position, it is possible to prevent the accidental slip-off from the first housing.

In order to achieve the third object, it is preferable that the lock ensuring member includes a projection which retains the lock ensuring member at the second position if the locking arm is deformed when the first housing and the second housing are engaged with each other.

In this configuration, it is possible to recognize that the locking arm is completely engaged with the locking member or not, that is, the second housing is completely engaged with the first housing or not.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

Figure 1:
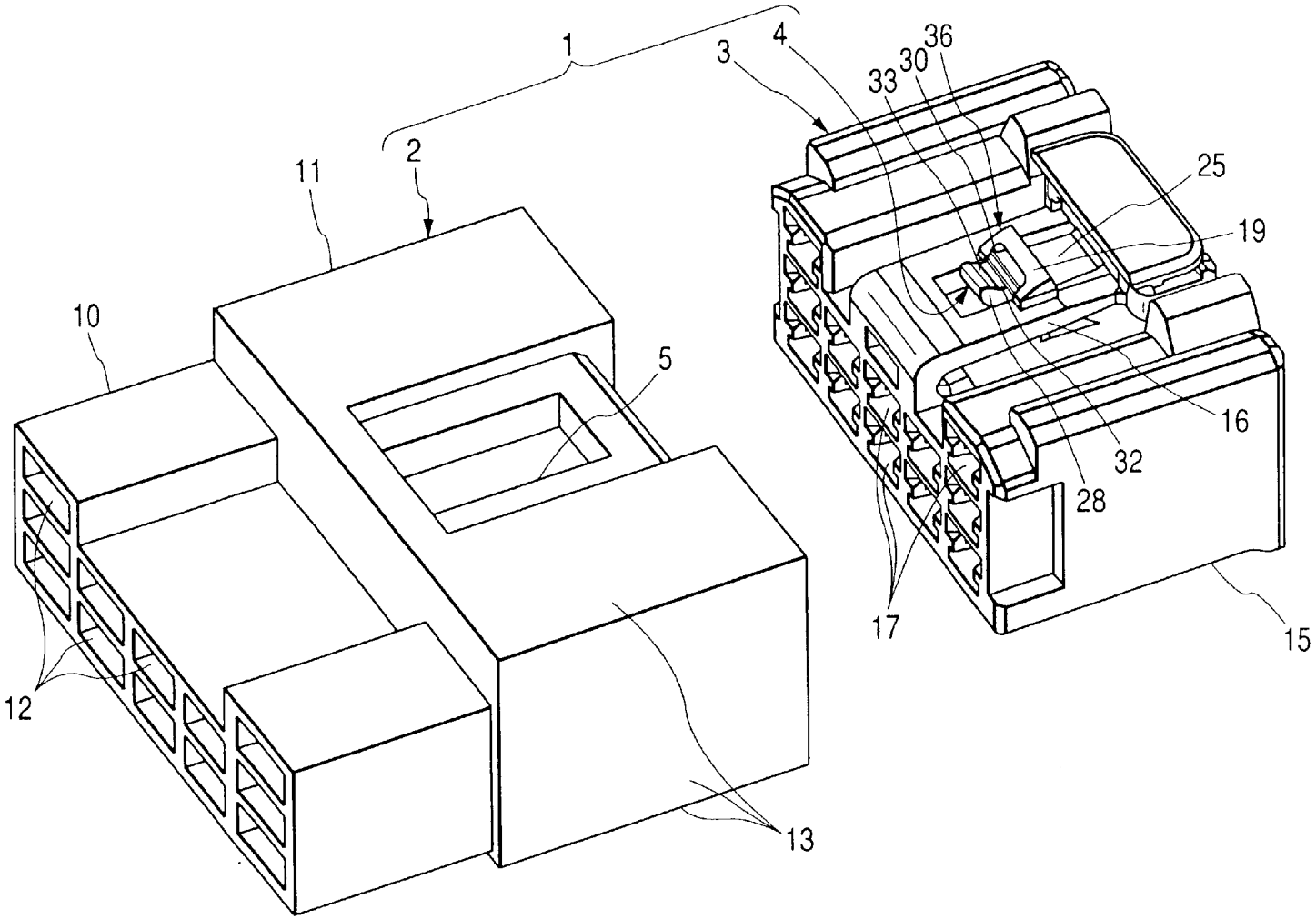
FIG. 1 is an exploded perspective view of a connector provided with a lock ensuring mechanism according to a first embodiment of the invention.

Referring to FIGS. 1 to 6, a description will be given of a connector provided with a lock ensuring mechanism in accordance with a first embodiment of the invention. It should be noted that the same component parts as those of the related connector 101 will be denoted by the same reference numerals, and a description thereof will be omitted. As shown in FIGS. 1 to 5, a lock ensuring member is comprised of a female-type connector housing (hereafter referred to as a female housing) 2, a male-type connector housing (hereafter referred to as a male housing) 3, and a lock ensuring member 4.

As shown in FIGS. 1 to 5, the female housing 2 has a main body 10 for accommodating a plurality of terminal fittings (not shown) made of a synthetic resin and a hood portion 11 for receiving the male housing 3. The main body 10 has a plurality of terminal chambers 12 which are juxtaposed to each other. The terminal chambers 12 respectively extend linearly to accommodate the aforementioned terminal fittings. It should be noted that, in the drawings, retaining arms for retaining and fixing the terminal fittings are omitted.

The hood portion 11 has a plurality of peripheral walls 13 respectively continuing to outer edges of the main body 10, and is formed in a box shape. Namely, the hood portion 11 is integral with the main body 10. Edge potions of the peripheral walls 13 which are apart from the main body 10 form an opening for receiving the male housing 3.

A locking hole 5 is formed in one peripheral wall 13 located on the upper side of the hood portion 11 in the drawing. The locking hole 5 extends through the one peripheral wall 13. The locking hole 5 is provided in a widthwise center of the peripheral wall 13 and in a center of the peripheral wall 13 as viewed in a direction in which the main body 10 and the hood portion 11 are connected to each other.

As shown in FIGS. 1 to 5, the male housing 3 has a main body 15 for accommodating a plurality of terminal fittings 40 (shown in FIG. 6) made of a synthetic resin and a locking arm 16. The main body 15 has a plurality of terminal chambers 17 which are juxtaposed to each other. The terminal chambers 17 respectively extend linearly to accommodate the aforementioned terminal fittings 40. The terminal chambers 17 respectively have retaining arms 18 for retaining the terminal fittings 40 therein. The main body 15 is inserted into the hood portion 11 such that the terminal chambers 17 and the terminal chambers 12 are integral with each other.

The locking arm 16 is formed in the shape of a strip, and one end portion thereof is integral with an edge portion of the main body 15 which is located close to the hood portion 11. The other end portion of the locking arm 16 is a free end so that the locking arm 16 is held by an outer wall of the male housing 3 in a cantilevered manner. The longitudinal direction of the locking arm 16 extends in the direction in which the housings 2 and 3 approach each other when the housings 2 and 3 are engaged with each other (hereinafter, this direction will be referred as an engagement direction). Namely, the locking arm 16 extends along the longitudinal direction of the terminal fitting 40 accommodated in the male housing 3. The locking arm 16 is elastically deflectable such that its free end portion projects out of or dips into the outer wall of the main body 15.

The locking arm 16 is provided with a locking projection 36 (shown in FIGS. 1 to 5) at its longitudinally central portion, and is provided with a supporting portion 37 (shown in FIGS. 3 to 5) extending from the central portion to the other end portion. The locking projection 36 projects from a top face of the locking arm 16 outwardly of the male housing 3. The locking projection 36 is to be engaged with the locking hole 5. The locking projection 36 straddles a supporting groove 20, which will be described later, along the widthwise direction of the locking arm 16.

The locking projection 36 has an inclined face 19, a through hole 30, and a guide face 31. The inclined face 19 opposes the female housing 2 when the male housing 3 is engaged with the female housing 2. When viewed in the engaging direction, the inclined face 19 is inclined gradually in a direction toward the inner side of the male housing 3. An edge of the hood portion 11 of the female housing 2 abuts against the inclined face 19 when the male housing 3 is engaged with the female housing 2.

The through hole 30 is formed through an end portion of the locking projection 36 located close to the female housing 2, and communicates with the supporting groove 20. The guide face 31 is formed at an edge portion of the through hole 30 which is apart from the female housing 2. When viewed in the direction of moving away from the female housing 2 with respect to the engaging direction (hereinafter, this direction will be referred as a disengaging direction), the guide face 31 is inclined gradually in the direction toward the inner side of the male housing 3.

Figure 3:
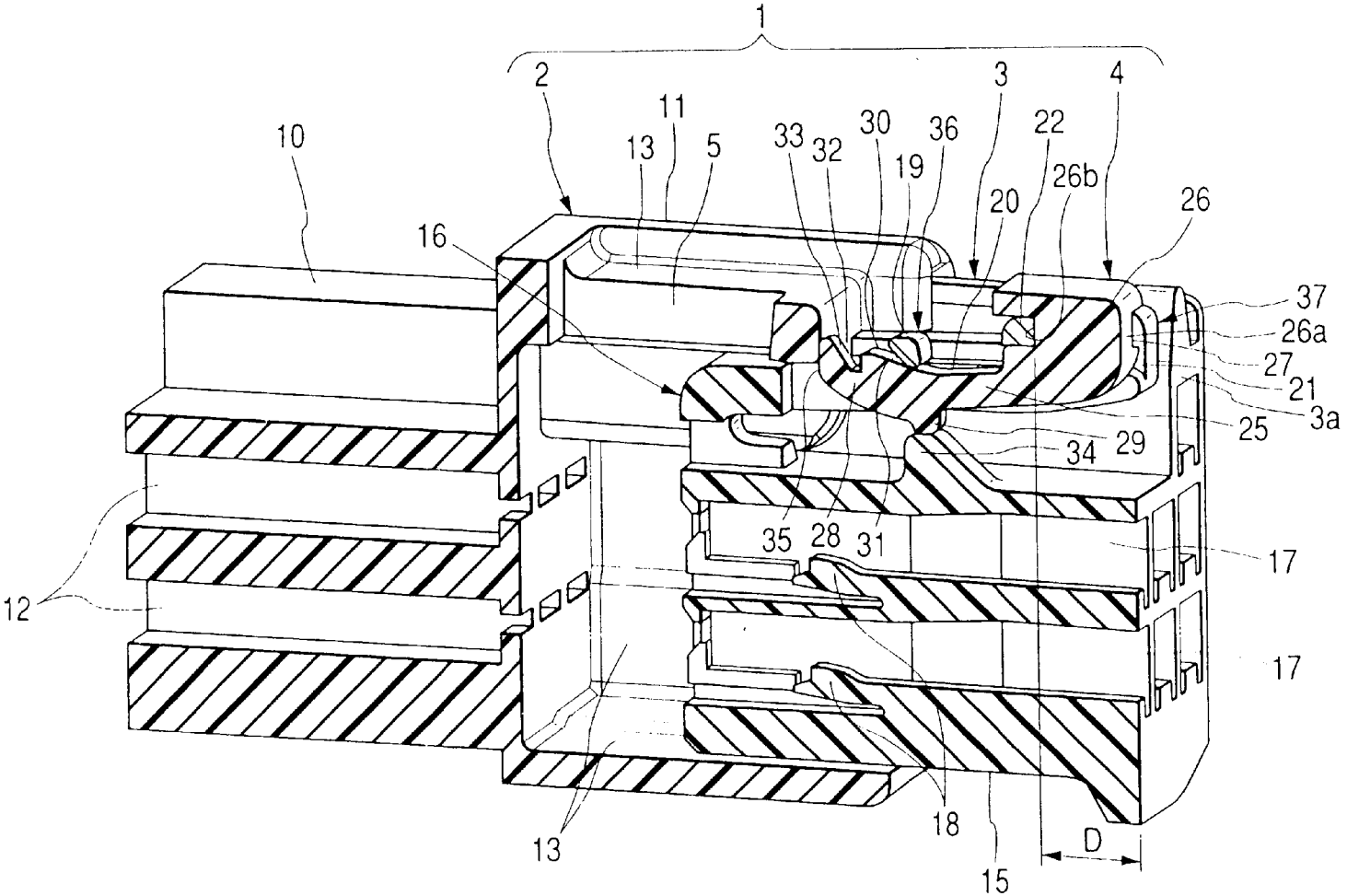
FIG. 3 is a cross-sectional perspective view of a state in which a peripheral wall of the female housing and an abutment face of a lock ensuring member abut against each other.

As shown in FIG. 3 and other drawings, the supporting portion 37 has the supporting groove 20, guide portions 21, a stopper 22, and the like. The supporting groove 20 is formed through the locking arm 16 in such a manner as to extend from the free end portion to the central portion. The supporting groove 20 is provided in the widthwise center of the locking arm 16. The supporting groove 20 allows a main body 25, which will be described later, of the lock ensuring member 4 to be passed therethrough on its inner side.

As shown in FIG. 3 and other drawings, each guide portion 21 has a guide projection (not shown) provided at the free end portion of the locking arm 16 and adapted to enter a guide groove 27 formed in a proximal portion 26, which will be described later, of the lock ensuring member 4. The guide projection extends in the engaging direction. The guide projection supports the proximal portion 26 such that the proximal portion 26 is movable in directions in which the housings 2 and 3 approach or move away from each other. Namely, the supporting member 37 supports the lock ensuring member 4 so as to be movable along the longitudinal directions of the terminal fittings accommodated in both housings 2 and 3.

The stopper 22 is provided at the free end portion of the locking arm 16. The stopper 22 comes into contact with the proximal portion 26 of the lock ensuring member 4 which has been moved toward the female housing 2. By coming into contact with the proximal portion 26, the stopper 22 restricts the lock ensuring member 4 moved toward the female housing 2 from coming off the supporting portion 37. Namely, the stopper 22 restricts the position of the lock ensuring member 4 located close to the female housing 2.

As shown in FIGS. 1 to 5, the lock ensuring member 4 has the main body 25 formed in the shape of an arm, a release stopper 28, a projection 29, and the proximal portion 26. The main body 25 is disposed in the supporting groove 20 such that its longitudinal direction extends in the engaging direction. The main body 25 is elastically deflectable such that the release stopper 28 is displaced perpendicularly to the engaging direction.

The release stopper 28 is provided at one end portion of the main body 25 located close to the female housing 2. When the proximal portion 26 has come into contact with the stopper 22, the release stopper 28 projects outwardly of the male housing 3 from the outer face of the locking arm 16 through the supporting groove 20 and the through hole 30. It should be noted that when the proximal portion 26 has come into contact with the stopper 22, the release stopper 28 is positioned closer to the female housing 2 side than the locking projection 36. It should be noted that, in this state, the release stopper 28 is in a locked position which is described herein and in which the release stopper 28 is engaged with the locking projection 36, i.e., the locking arm 16.

Figure 5:
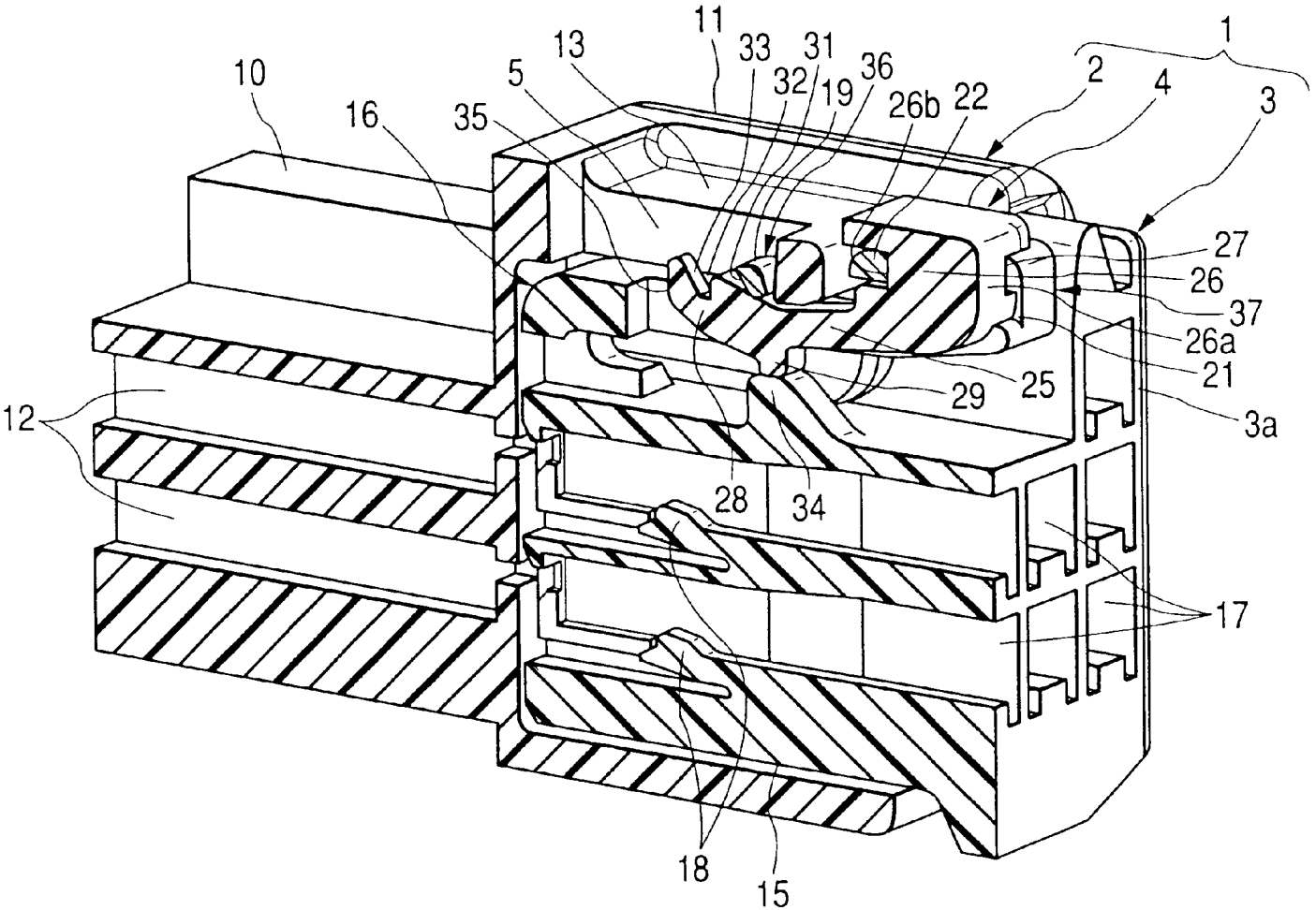
FIG. 5 is a cross-sectional perspective view of a state in which the female housing and the male housing are engaged with each other.

In the locked position, the release stopper 28 is engaged with the locking projection 36, i.e., the locking arm 16. In the state in which the locking projection 36 is engaged with the locking hole 5, i.e., the housings 2 and 3 are engaged with each other, as shown in FIG. 5, the release stopper 28 is positioned in the locked position so as to clamp the locking projection 36 in cooperation with an inner edge of the locking hole 5. By doing so, the release stopper 28 restricts the male housing 3 from coming off the hood portion 11 of the female housing 2.

In addition, as shown in FIGS. 2 to 5, the release stopper 28 has a locking recess 32 and an abutment face 35. The locking recess 32 is formed in a concave shape in the face of the release stopper 28 which is located on the outer side of the male housing 3. When the lock ensuring member 4 moves in a direction away from the female housing 2, the locking projection 36 enters the locking recess 32. The locking projection 36 has a guide face 33 which comes into contact with the guide face 31 of the locking projection 36 which entered its inner side.

The guide face 33 is formed on an inner edge of the locking recess 32 which is located close to the female housing 2. When viewed in the disengaging direction, the guide face 33 is inclined gradually in the direction toward the inner side of the male housing 3.

When the lock ensuring member 4 is moved in the direction away from the female housing 2, the locking projection 36 enters the inner side of the locking recess 32 of the release stopper 28. Further, when the lock ensuring member 4 is moved in the direction away from the female housing 2, the release stopper 28 and the locking projection 36 undergo relative displacement along the guide faces 31 and 33. Namely, the guide faces 31 and 33 cause the release stopper 28 to be displaced in the direction away from the locking projection 36. The main body 25 undergoes resilient deformation for the guide faces 31 and 33 so that the release stopper 28 moves toward the inner side of the male housing 3.

Then, the outer face of the locking arm 16 and the outer face of the release stopper 28 become substantially flush. The position where the outer face of the locking arm 16 and the outer face of the release stopper 28 become substantially flush constitutes an unlocked position described herein. In this unlocked position, the engagement of the release stopper 28 with the locking projection 36, i.e., the locking arm 16, is canceled. Thus, the lock ensuring member 4 is supported in the male housing 3 in such a manner as to be capable of freely movable between the locked position and the unlocked position.

The abutment face 35 is an end face of the release stopper 28 which is closest to the female housing 2. In the locked position, the abutment face 35 projects outwardly of the male housing 3 from the outer face of the locking arm 16. The abutment face 35 in the locked position abuts against an edge portion of the hood portion 11 of the female housing 2. Namely, when the release stopper 28 is engaged with the locking projection 36, i.e., the locking arm 16, the abutment face 35 is abutted against the female housing 2. In the unlocked state, the abutment face 35 does not project outwardly of the male housing 3 from the outer face of the locking arm 16.

The projection 29 projects toward the inner side of the male housing 3 from a longitudinally central portion of the main body 25. The proximal portion 26 is provided at an end portion of the main body 25 which is apart from the female housing 2. The proximal portion 26 has the guide grooves 27 extending in the engaging direction. The guide projections enter the respective guide grooves 27.

As the guide projections enter the associated guide grooves 27, the proximal portion 26 is supported in the male housing 3 in such a manner as to be movable in the engaging and disengaging directions. It should be noted that, in the state in which the lock ensuring member 4 is located in the locked position, the proximal portion 26 is recessed from the outer wall of the female housing 2 which is the farthest from the female housing 2, as shown in FIGS. 3 and 5.

Figure 4:
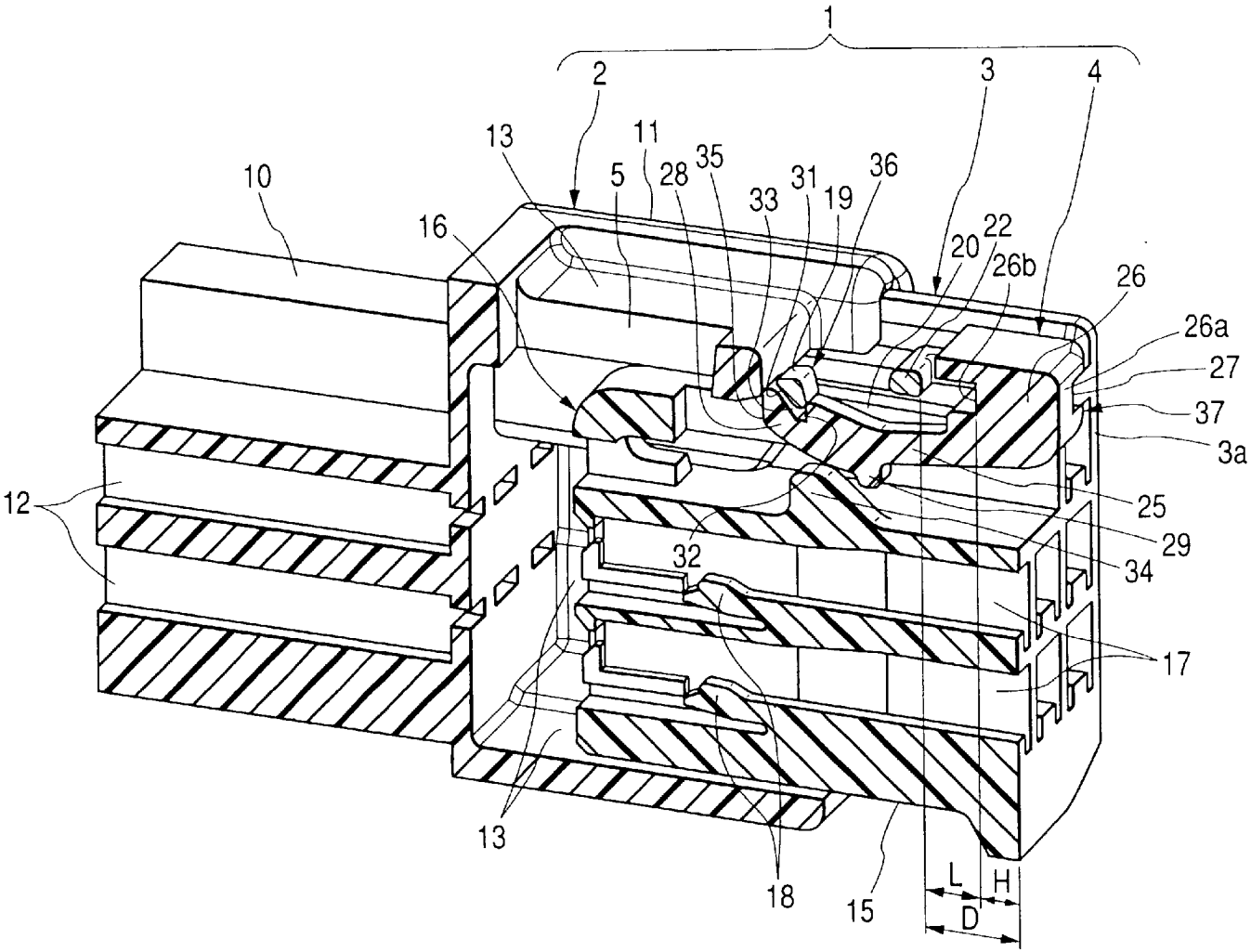
FIG. 4 is a cross-sectional perspective view of a state in which the lock ensuring member has been pressed in the direction away from the female housing by the female housing.

In addition, in the state in which the lock ensuring member 4 is located in the unlocked state, the proximal portion 26 is flush with an outer wall 3*a* (shown in FIG. 3 and the like) of the main body 15 which is the farthest from the female housing 2, or is slightly recessed from the outer wall 3*a,* as shown in FIG. 4 and the like. Thus, the proximal portion 26 does not project from the outer wall of the male housing 3 when the lock ensuring member 4 moves between the locked position and the unlocked position.

Further, the male housing 3 has a locking projection 34. The locking projection 34 is formed convexly on an inner wall face of the main body 15 which is located at the bottom of the supporting groove 20. The locking projection 34 abuts against the projection 29 when the lock ensuring member 4 is located in the locked position. When the locking projection 34 abuts against the projection 29, the locking projection 34 maintains a state in which the release stopper 28 projects to the outer side of the male housing 3. Namely, when the locking projection 34 abuts against the projection 29, the locking projection 34 restricts the release stopper 28 from being away from the locking projection 36. In addition, the locking projection 34 does not hamper the movement of the lock ensuring member 4 between the locked position and the unlocked position.

Figure 2:
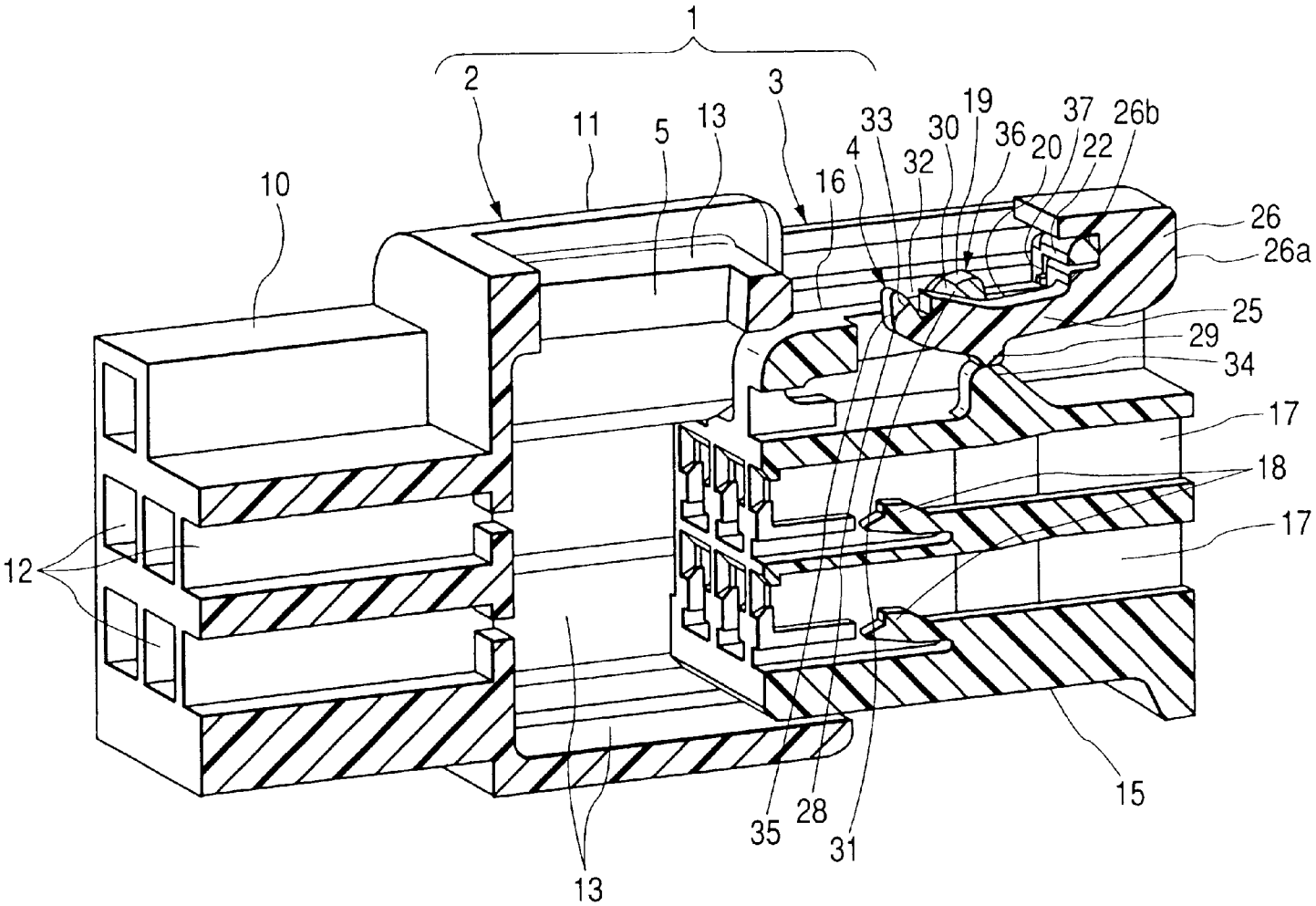
FIG. 2 is a cross-sectional perspective view of a state in which a male housing begins to be inserted in a female housing in the connector of FIG. 1.

In accordance with the above-described arrangement, before engagement between the female housing 2 and the male housing 3, the lock ensuring member 4 is located in the locked position and is engaged with the locking projection 36. To allow the female housing 2 and the male housing 3 to be engaged with each other, the opening of the hood portion 11 and the openings of the terminal chambers 17 are first opposed to each other, as shown in FIG. 1. At this time, the release stopper 28 is located in the locked position in which it is engaged with the locking projection 36. The male housing 3 is gradually inserted in the locking projection 36, as shown in FIG. 2. Then, as shown in FIG. 3, an edge portion of one peripheral wall 13 and the abutment face 35 abut against each other.

As the male housing 3 is further inserted gradually into the hood portion 11, the lock ensuring member 4 moves away from the female housing 2 by being pressed by the edge portion of the one peripheral wall 13, i.e., the female housing 2. Subsequently, as shown in FIG. 4, the locking projection 36 enters the locking recess 32. As the male housing 3 is gradually inserted into the hood portion 11, the release stopper 28 becomes displaced toward the inner side of the male housing 3 while being guided by the guide faces 31 and 33. It should be noted that, at this time, the main body 25 of the lock ensuring member 4 is elastically deformed. Then, the release stopper 28 is located at the unlocked position.

When the release stopper 28 reaches the unlocked position, the release stopper 28 is located below the one peripheral wall 13. The one peripheral wall 13 rides over the locking projection 36. Then, the locking arm 16, while being guided by the inclined face 19, becomes elastically deformed such that the locking projection 36 is located below the one peripheral wall 13.

Thus, the lock ensuring member 4 moves in the direction away from the female housing 2 from the locked position toward the unlocked position until the locking arm 16 and the locking hole 5 are engaged with each other when the female housing 2 and the male housing 3 are fitted to each other. Then, as for the lock ensuring member 4, the proximal portion 26 which is apart from the female housing 2 does not project from the outer wall of the male housing 3 when the female housing 2 and the male housing 3 are fitted to each other.

When the male housing 3 is further inserted into the hood portion 11, the locking projection 36 enters the locking hole 5. When the locking projection 36 enters the locking hole 5, the locking projection 36 becomes displaced from below the one peripheral wall 13 toward the outer side of the male housing 3 by the elastically restoring force of the locking arm 16, and becomes engaged with the locking hole 5, as shown in FIG. 5.

The lock ensuring member 4 is moved toward the female housing 2. Then, the release stopper 28 clamps the locking projection 36 in cooperation with the inner edge of the locking hole 5 by the elastically restoring force of the main body 25 of the lock ensuring member 4. Namely, the release stopper 28 is engaged with the locking arm 16. Thus, the release stopper 28 is located at the locked position, thereby causing the female housing 2 and the male housing 3 to engage with each other.

In a case where the female housing 2 and the male housing 3 are in a semiengaged state, i.e., in a state in which the locking projection 36 is not engaged with the locking hole 5 because the locking projection 36 is located below one peripheral wall 13 or for other reason, the release stopper 28 hits the locking projection 36, so that the lock ensuring member 4 cannot be moved toward the locked position. In this way, by confirming whether or not the lock ensuring member 4 can be moved toward the locked position, it is possible to ascertain whether or not the housings 2 and 3 have been positively engaged.

On the other hand, in the state in which the housings 2 and 3 have been engaged with each other, the projection 29 of the lock ensuring member 4 and the locking projection 34 are brought into contact with each other. Then, the locking projection 34 restricts the main body 25 from becoming deformed in the direction in which the engagement of the locking arm 16 is canceled. For this reason, in the state in which the housings 2 and 3 are engaged with each other, even if an attempt is made to separate the housings 2 and 3 from each other, the release stopper 28 remains engaged with the locking arm 16. Accordingly, the mutually engaged housings 2 and 3 are not disengaged from each other unexpectedly.

Furthermore, if the lock ensuring member 4 located in the locked position is moved in the direction away from the female housing 2 in the state in which the housings 2 and 3 are engaged with each other, the locking projection 34 does not hamper the movement of the lock ensuring member 4. For this reason, the lock ensuring member 4 can be moved smoothly to the unlocked position, so that the engagement of the release stopper 28 with respect to the locking arm 16 can be canceled. Thus, the housings 2 and 3 can be easily separated.

Figure 6:
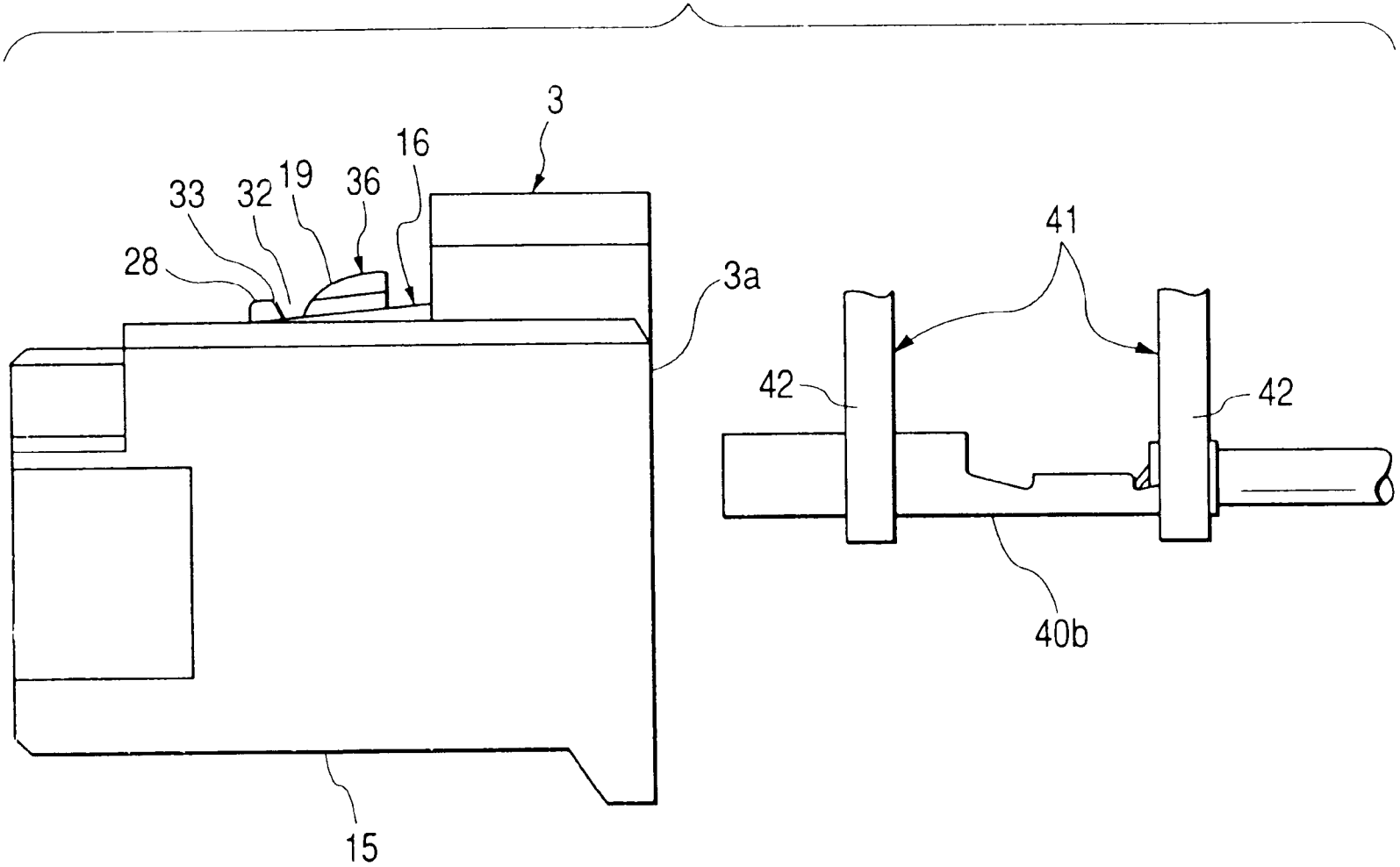
FIG. 6 is an explanatory diagram illustrating a state in which a terminal fitting is inserted into the male housing.

In accordance with this embodiment, when the housings 2 and 3 are engaged with each other, the proximal portion 26 of the lock ensuring member 4 does not project from the outer wall 3*a* of the male housing 3 when the female housing 2 and the male housing 3 are engaged with each other. For this reason, as shown in FIG. 6, when the terminal fittings 40 held by the chucks 41 or the like are inserted in the male housing 3, the lock ensuring member 4 does not interfere with the chuck 41. Thus, since the lock ensuring member 4 does not come into contact with the chuck 41, the insertion of the terminal fittings 40 into the terminal chambers 17 of the male housing 3 is not hampered. Accordingly, the connector 1 can be prevented from causing a hindrance during the manufacture of the wire harness, and it is possible to prevent the lock ensuring member 4 and the like from becoming damaged.

In addition, since the release stopper 28 is guided by the guide faces 31 and 33, the release stopper 28 does not hamper the engagement between the housings 2 and 3. Therefore, the housings 2 and 3 can be surely engaged with each other.

Further, since the stopper 22 restricts the position of the lock ensuring member 4 located close to the female housing 2, the lock ensuring member 4 can be prevented from coming off the male housing 3 particularly before the engagement of the housings 2 and 3.

In addition, with the connector 1 with a lock ensuring mechanism in accordance with this embodiment, an interval D (shown in FIGS. 3 and 4) between the stopper 22 and the outer wall 3*a* is equal to or greater than the sum of an amount of movement L (shown in FIG. 4) by which the lock ensuring member 4 moves in the direction away from the female housing 2 when the housings 2 and 3 are engaged with each other and an interval H between a portion 26*b* (shown in FIG. 4) of the lock ensuring member 4 for contact with the stopper 22 and an end face 26*a* (shown in FIG. 4 and the like) thereof which is the farthest from the female housing 2. For this reason, when the housings 2 and 3 are engaged with each other, the proximal portion 26 of the lock ensuring member 4 does not project from the outer wall 3*a* of the male housing 3 more reliably.

Furthermore, when the male housing 3 is to be engaged with the female housing 2, the lock ensuring member 4 is displaced from the locked position to the unlocked position. Consequently, an operator can easily recognize the lock ensuring member 4. Therefore, the operator hardly forgets to displace the lock ensuring member 4 toward the locked position. Accordingly, it is possible to reliably prevent the male housing 3 from accidentally slipping out of the female housing 2 after the fitting.

By confirming the position of the lock ensuring member 4, moreover, it is possible to reliably recognize that the locking arm 16 and the locking hole 5 are engaged with each other or not. Accordingly, it is possible to reliably prevent the male housing 3 from accidentally slipping out of the female housing 2 after the fitting.

It should be noted that although in the above-described embodiment the locking hole 5 is provided in the female housing 2, and the lock ensuring member 4 and the locking projection 36 are provided on the male housing 3, the invention is not limited to the same, and it goes without saying that the locking hole may be provided in the male housing 3, and the lock ensuring member 4 and the locking projection 36 may be provided on the female housing 2.

A connector provided with a lock ensuring mechanism according to a second embodiment of the invention will be described with reference to FIGS. 7 to 20. A connector 51 having a lock ensuring mechanism comprises a female housing 52, a male housing 53, and a lock ensuring member 54 as shown in FIGS. 7 and 13 to 18.

Figure 13:
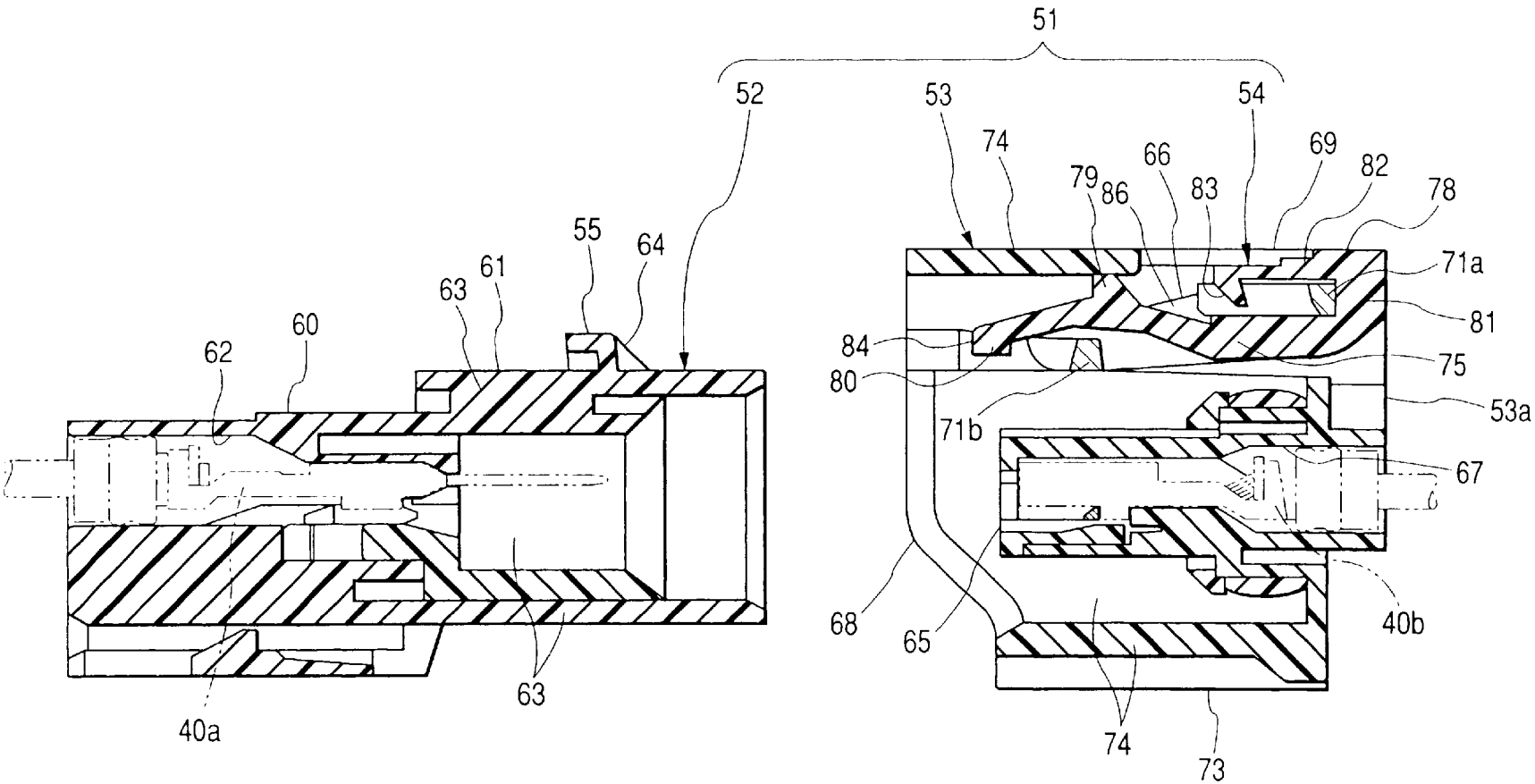
FIG. 13 is a sectional view taken along a line XIII—XIII in FIG. 7.

The female housing 52 is formed of a synthetic resin. The female housing 52 includes a main body 60 and a cylindrical hood portion 61 as shown in FIGS. 7 and 13 to 18. The main body 60 accommodates a plurality of male type terminal fittings (which will be hereinafter referred to as male terminals) 40*a* as shown in FIG. 13. The main body 60 includes a plurality of terminal chambers 62 juxtaposed with each other. The terminal chambers 62 are extended linearly and accommodate the male terminals 40*a,* respectively.

The hood portion 61 accepts therein a main body 65 of the male housing 53 which will be described later. The hood portion 61 includes a plurality of peripheral walls 63 integral with outer edges of the main body 60 respectively and is formed like a box (cylindrically). In other words, the hood portion 61 is integral with the main body 60. The edge portion of the peripheral wall 63 which is provided apart from the main body 60 forms an opening for receiving the main body 65 of the male housing 53.

A locking projection 55 is formed on one of the peripheral walls 63 of the hood portion 61 which is positioned on the upper side in the drawing. The locking projection 55 is protruded from the outer face of the peripheral wall 63. The locking projection 55 is provided on the center of the peripheral wall 63 with regard to width and longitudinal directions.

A tapered face 64 is provided on the end of the locking projection 55 which is closer to the opening. The tapered face 64 is inclined with respect to the outer face of the peripheral wall 63 and a direction orthogonal to the outer face in such a direction as to be gradually separated from the opening when gradually going away from the peripheral wall 63. The locking projection 55 is engaged with a locking hole 86 of a locking arm 66 which will be described later.

The male housing 53 is formed of a synthetic resin and includes a main body 65, a hood portion 73 and the locking arm 66 as shown in FIGS. 7 and 13 to 18. The main body 65 accommodates a plurality of female type terminal fittings (which will be hereinafter referred to as female terminals) 40*b* as shown in FIG. 13. The main body 65 includes a plurality of terminal chambers 67 juxtaposed with each other. The terminal chambers 67 are extended linearly and accommodate the female terminals 40*b,* respectively. The main body 65 is inserted in the hood portion 61 such that the terminal chamber 67 and the terminal chamber 62 of the female housing 52 are communicated with each other.

The hood portion 73 includes a plurality of peripheral walls 74 and is formed like a box (cylindrically). The hood portion 73 accommodates the main body 65 therein. Each of the peripheral walls 74 constituting the hood portion 73 has one end integral with the outer edge of the main body 65. The hood portion 73 accepts the female housing 52 therein. The other end of the peripheral wall 74 forms an opening 68 for accepting the female housing 52. Moreover, a cutout 69 is provided on one of the peripheral walls 74, which is positioned on the upper side in the drawing, so as to penetrate the peripheral wall 74.

Figure 12:
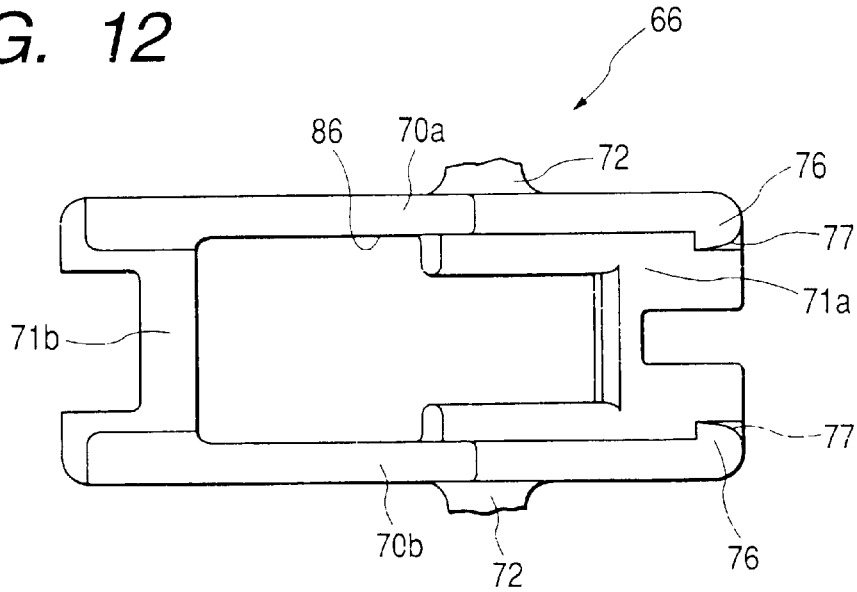
FIG. 12 is a plan view showing, from below, the locking arm of the connector in FIG. 7.

The locking arm 66 is formed of a synthetic resin and is elastically deformable. The locking arm 66 includes a pair of first rod members 70*a* and 70*b* and a pair of second rod members 71*a* and 71*b* and is formed like a frame as shown in FIG. 12. The first rod members 70*a* and 70*b* are provided in parallel with each other at an interval. The second rod members 71*a* and 71*b* are shorter than the first rod members 70*a* and 70*b*. The second rod members 71*a* and 71*b* are provided in parallel with each other at an interval. The respective second rod members 71*a* and 71*b* couple opposite ends of the first rod members 70*a* and 70*b* to each other.

The locking arm 66 is provided in the hood portion 73. The locking arm 66 is disposed between the peripheral wall 74 provided with the cutout 69 and the main body 65. The longitudinal direction of the locking arm 66 is parallel with that of the terminal chamber 67, that is, the female terminal 40*b*. The longitudinal direction of the locking arm 66 is set to the engaging direction. A pair of supporting pieces 72 (shown in FIG. 12) are attached to the center in the longitudinal direction of the locking arm 66.

The supporting piece 72 is integral with both edges in the width direction of the locking arm 66. The supporting piece 72 is integral with both an edge in the width direction of the locking arm 66 and the inner face of the hood portion 73.

The supporting piece 72 is formed integrally with both the locking arm 66 and the hood portion 73. The supporting piece 72 is elastically deformable. Therefore, the locking arm 66 is supported to be freely displaced with respect to the hood portion 73 around the center in the longitudinal direction. More specifically, when the supporting piece 72 is elastically deformed, the center in the longitudinal direction of the locking arm 66 is rarely displaced with respect to the hood portion 73 and both ends in the longitudinal direction of the locking arm 66 are displaced with respect to the hood portion 73.

A claw 76 is provided on each one end of the first rod members 70*a* and 70*b* which is provided apart from the opening 68 as shown in FIG. 12. The claws 76 are protruded inwardly. An inclined face 77 is provided on each end of the claw 76 so as to be inclined with respect to both the longitudinal and width directions of the locking arm 66.

The inside of the locking arm 66 constitutes a locking hole 86 with which the locking projection 55 is to be engaged.

Figure 10:
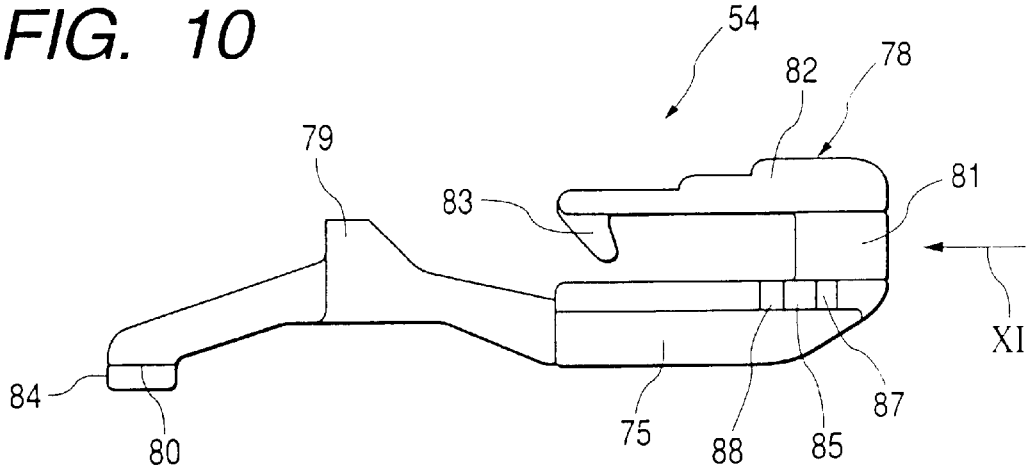
FIG. 10 is a side view showing the lock ensuring member in FIG. 7.
Figure 11:
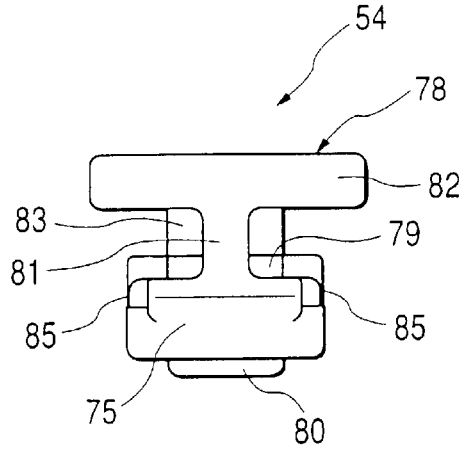
FIG. 11 is a front view showing the lock ensuring member seen in a direction of an arrow XI in FIG. 10.

The lock ensuring member 54 is formed of a synthetic resin and is elastically deformable. The lock ensuring member 54 includes a main body 75 formed like an arm, an attachment portion 78, an abutment portion 80 and a projection 79 as shown in FIGS. 10 and 11.

The main body 75 is inserted into the locking hole 86 in such a state that a longitudinal direction is set to be the engaging direction. A proximal end of the main body 75 which is apart from the opening 68 is provided between the second rod member 71*a* provided apart from the opening 68 and the main body 65 as shown in FIG. 13. A leading end of the main body 75 which is closer to the opening 68 is provided between the second rod member 71*b* closer to the opening 68 and the peripheral wall 74. More specifically, the main body 75 of the lock ensuring member 54 is inserted into the locking hole 86 of the locking arm 66 in a state that the proximal end thereof is positioned between the locking arm 66 and the main body 65 and the leading end thereof is positioned between the locking arm 66 and the peripheral wall 74.

The attachment portion 78 is integral with the proximal end of the main body 75. The attachment portion 78 includes a first extended portion 81, a second extended portion 82 and an engaging claw 83 and is formed to have an L shape seen from the side. The first extended portion 81 is extended from the proximal end of the main body 75 toward the outer direction of the male housing 53 such an extent as well as the thickness of the second rod member 71*a*. The second extended portion 82 is extended from the end of the first extended portion 81 which is provided apart from the main body 75 toward the opening 68 in parallel with the main body 75. The second extended portion 82 has a greater width than that of the second rod member 71*a*. The engaging claw 83 is extended from the end of the second extended portion 82 which is closer to the opening 68 toward the main body 75.

The attachment portion 78 is attached to the locking arm 66 in such a manner that the engaging claw 83 enters the inside of the locking hole 86 and the second rod member 71*a* is accommodated between the first extended portion 81, the second extended portion 82 and the engaging claw 83. Consequently, the attachment portion 78, that is, the lock ensuring member 54 is slidably supported on the locking arm 66 between a position in which the first extended portion 81 comes in contact with the second rod member 71*a* (which will be hereinafter referred to as a locked position shown in FIG. 13) and a position in which the engaging claw 83 comes in contact with the second rod member 71*a* (which will be hereinafter referred to as an unlocked position shown in FIG. 15). Moreover, when the attachment portion 78 is attached to the locking arm 66, the second extended portion 82 is exposed outward through the cutout 69.

The engaging claw 83 forms a spacing together with the second rod member 71*a* in the locked position. The first extended portion 81 forms a spacing together with the second rod member 71*a* in the unlocked position. In the locked position, moreover, the attachment portion 78 is provided on the level with an outer face 53*a* (shown in FIG. 13) of the male housing 53 which is the most distant from the female housing 52 or is slightly concaved from the outer face 53*a*. In the unlocked position, the attachment portion 78 is protruded from the outer face 53*a* (shown in FIG. 15) of the male housing 53.

The abutment portion 80 is provided on the leading end of the main body 75. The abutment portion 80 is extended from the other end toward the main body 65. In the locked position, the abutment portion 80 forms a spacing together with the second rod member 71*b* which is closer to the opening 68. In the unlocked position, the abutment portion 80 comes in contact with the second rod member 71*b* which is closer to the opening 68. The lock ensuring member 54 slidably supported on the locking arm 66 does not slip out of the locking arm 66 by the attachment portion 78 and the abutment portion 80. More specifically, the lock ensuring member 54 can be prevented from approaching the female housing 52 from the locked position and can be prevented from going away from the female housing 52 from the unlocked position.

A face 84 (hereinafter referred to as a contact face) of the abutment portion 80 which is closer to the opening 68 is flat. The contact face 84 is orthogonal to the engaging direction. The contact face 84 comes in contact with the locking projection 55 of the female housing 52 during an engaging operation of the housings 52 and 53.

The projection 79 is provided on a central part in the longitudinal direction of the main body 75. The projection 79 is extended from the main body 75 toward the peripheral wall 74 described above. In the locked position, the projection 79 comes in contact with the inner face of the peripheral wall 74 or is opposed to the inner face. Moreover, the projection 79 is exposed through the cutout 69 in the unlocked position.

Moreover, the width of the proximal end of the main body 75 is almost equal to the spacing between the claws 76. A pair of convex portions 85 are provided on the proximal end of the main body 75. The convex portion 85 is protruded outwardly from both edges in the width direction of the main body 75 as shown in FIG. 11. The convex portion 85 includes a first inclined face 87 and a second inclined face 88 as shown in a two-dotted chain line in FIGS. 19 and 20.

The first inclined face 87 is provided on the end of the convex portion 85 which is provided apart from the opening 68, that is, closer to the outside of the male housing 53. The first inclined face 87 is inclined with respect to both of the longitudinal and width directions of the main body 75 in such a direction as to gradually approach the main body 75 when going away from the opening 68, that is, going toward the outside of the male housing 53. The first inclined face 87 is opposed to the claw 76 in the locked position as shown in FIG. 20.

Figure 19:
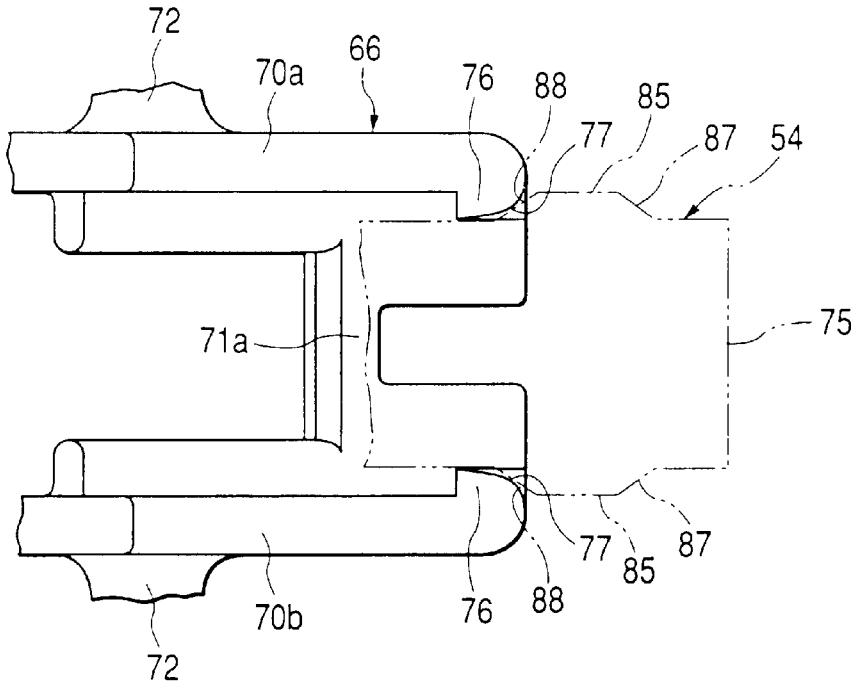
FIG. 19 is a view schematically illustrating the positional relationship between a claw and a convex portion in the unlocked position of the connector shown in FIG. 7.

The second inclined face 88 is provided on the end of the convex portion 85 which is provided closer to the opening 68, that is, closer to the inside of the male housing 53. The second inclined face 88 is inclined with respect to both of the longitudinal and width directions of the main body 75 in such a direction as to gradually approach the main body 75 when approaching the opening 68, that is, going toward the inside of the male housing 53. The second inclined face 88 is opposed to the inclined face 77 of the claw 76 in the unlocked position as shown in FIG. 19.

Figure 20:
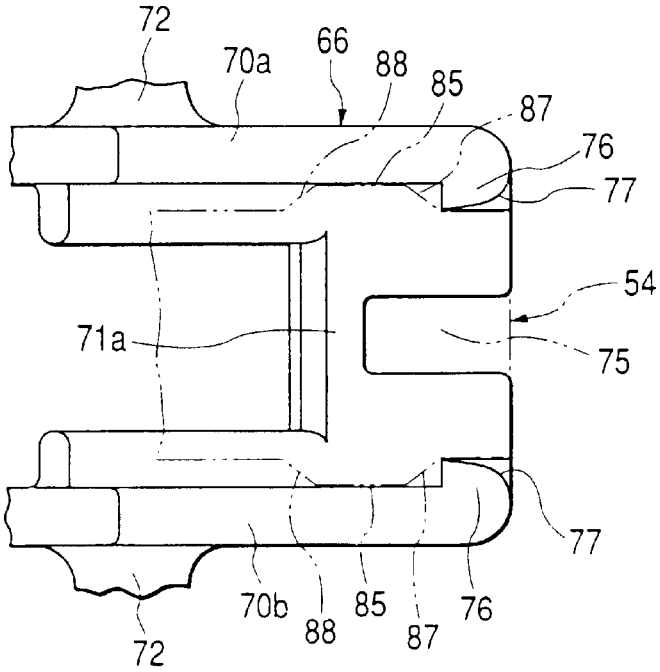
FIG. 20 is a view schematically illustrating the positional relationship between the claw and the convex portion in the locked position of the connector shown in FIG. 7.
Figure 21:
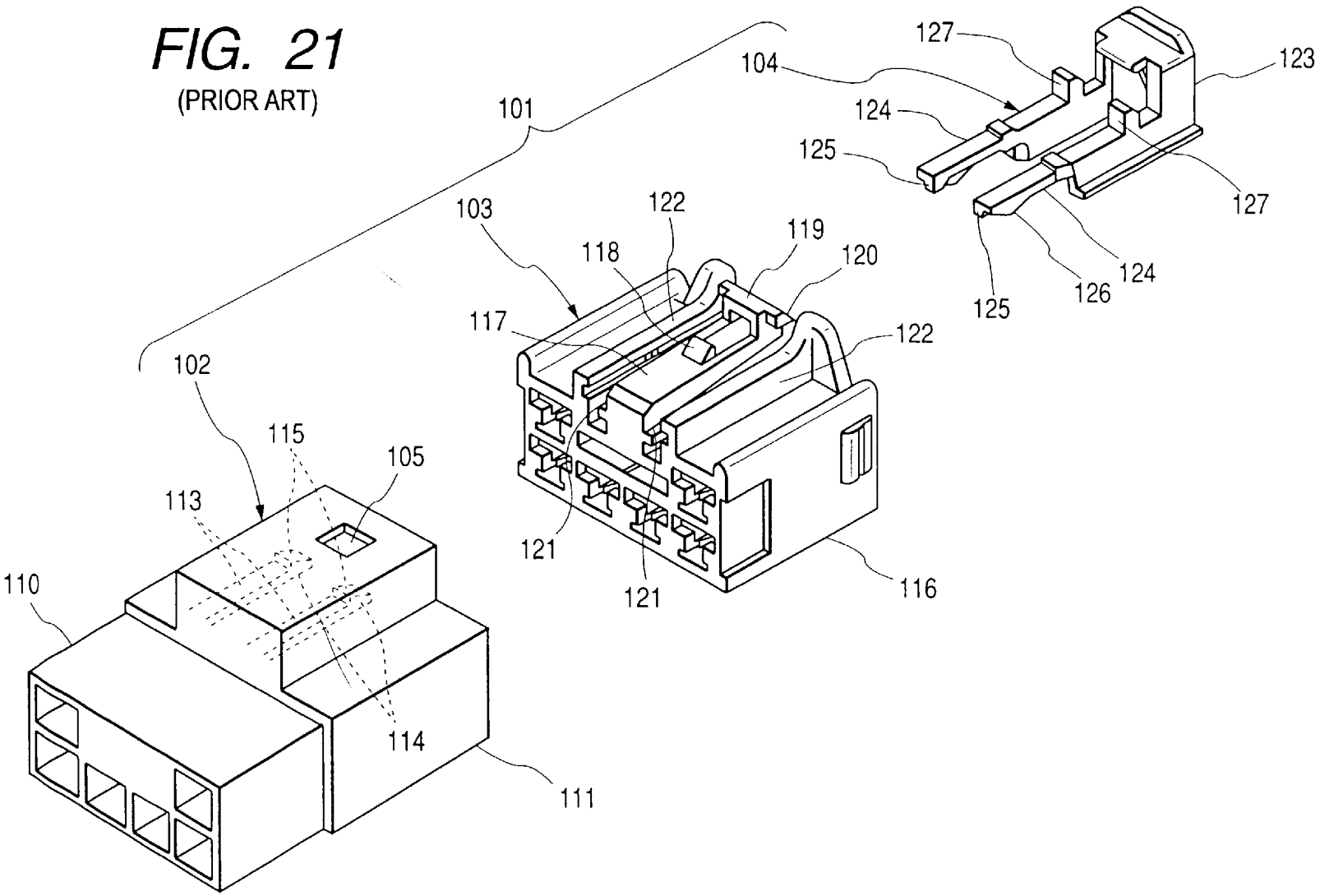
FIG. 21 (PRIOR ART)
FIG. 21 is an exploded perspective view of a related connector provided with a lock ensuring mechanism.
Figure 22:
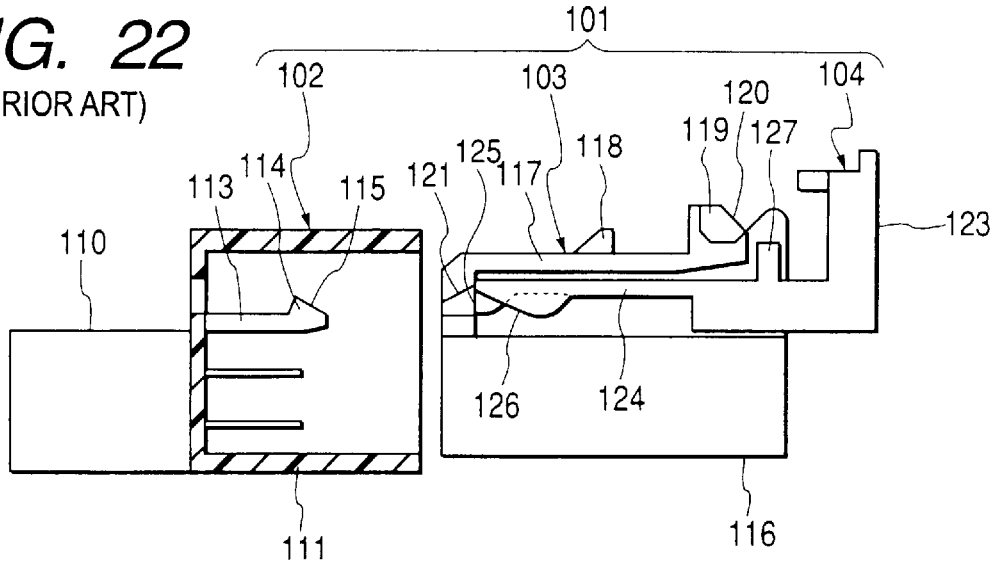
FIG. 22 (PRIOR ART)
FIG. 22 is a side elevational view illustrating essential portions of a female housing and a male housing of the related connector in FIG. 21.
Figure 23:
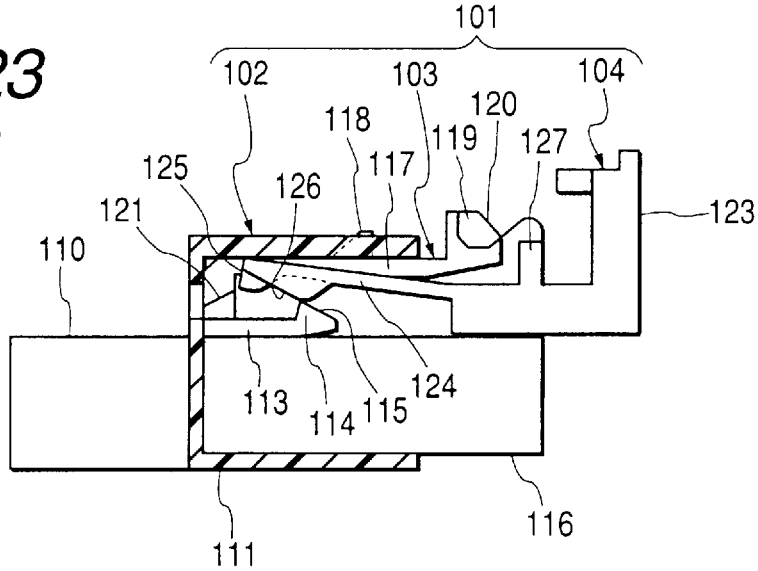
FIG. 23 (PRIOR ART)
FIG. 23 is an explanatory diagram illustrating the process of inserting the male housing into the female housing of the related connector in FIG. 21.
Figure 24:
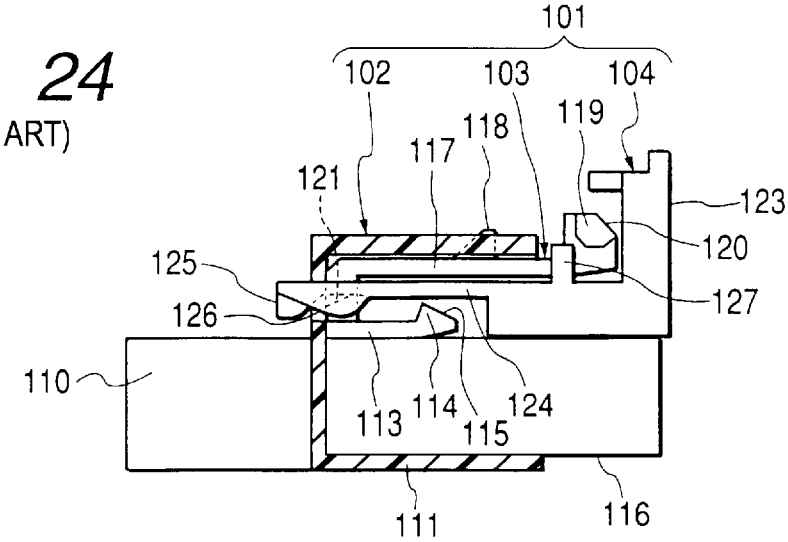
FIG. 24 (PRIOR ART)
FIG. 24 is an explanatory diagram illustrating a state in which the male housing and the female housing of the related connector in FIG. 21 are engaged with each other.
Figure 25A:
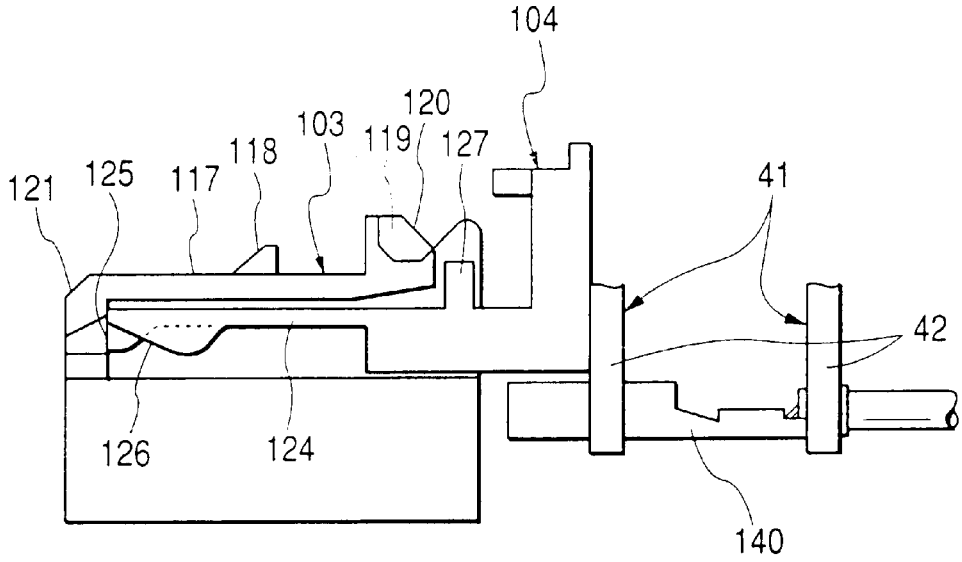
FIG. 25A (PRIOR ART)
FIG. 25A is an explanatory diagram illustrating a state in which a terminal fitting is inserted into the male housing to which the lock ensuring member shown in FIG. 22 has been attached.
Figure 25B:
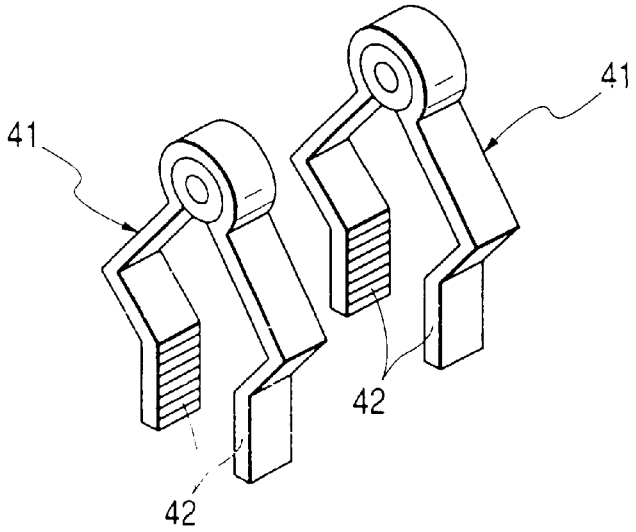
FIG. 25B (PRIOR ART)
FIG. 25B is a perspective view illustrating chucks shown in FIG. 25A.

In the locked position, the first inclined face 87 is opposed to the claw 76 and the convex portion 85 is positioned between the first rod members 70*a* and 70*b*, that is, on the inside of the locking arm 66 as shown in FIG. 20. When the lock ensuring member 54 is displaced toward the outside of the male housing 53, the first inclined face 87 comes in contact with the claw 76. Consequently, the locking arm 66 is elastically deformed in such a direction that the spacing between the first rod members 70*a* and 70*b* is enlarged. Thus, elastic restoring force is generated. Then, the claw 76 goes beyond the convex portion 85 and is displaced to the unlocked position in which the second inclined face 88 is opposed to the inclined face 77 of the claw 76 as shown in FIG. 19. Consequently, the elastic restoring force is eliminated.

Moreover, also in the case in which the displacement is carried out from the unlocked position toward the locked position, the locking arm 66 is once deformed elastically in such a direction that the spacing between the first rod members 70*a* and 70*b* is enlarged. Consequently, elastic restoring force is generated. When the displacement to the locked position is carried out, the elastic restoring force is eliminated. Thus, when the displacement is carried out from the locked position to the unlocked position and from the unlocked position to the locked position by the claw 76 and the convex portion 85, the locking arm 66 is elastically deformed so that the elastic restoring force is generated. For this reason, a resistance is generated together with the elastic restoring force when the displacement is carried out from the locked position to the unlocked position and from the unlocked position to the locked position.

Consequently, the claw 76 and the convex portion 85 give a click feeling to the lock ensuring member 54 to be displaced from the locked position to the unlocked position and from the unlocked position to the locked position. Furthermore, the claw 76 and the convex portion 85 maintain the lock ensuring member 54 set in the locked position and maintains the lock ensuring member 54 set in the unlocked position. Moreover, the claw 76 and the convex portion 85 are engaged with each other between the locked position and the unlocked position through the inclined faces 87 and 88.

In the locked position, the projection 79 comes in contact with the inner face of the peripheral wall 74 or is opposed thereto. For this reason, the leading end of the main body 75 is restricted to be displaced toward the outside of the male housing 53. Accordingly, the elastic deformation of the locking arm 66 is restricted. Thus, the projection 79 of the lock ensuring member 54 restricts the elastic deformation of the locking arm 66 in the locked position.

In the unlocked position, the projection 79 is exposed to the outside of the male housing 53 through the cutout 69. Consequently, the leading end of the main body 75 is allowed to be displaced toward the outside of the male housing 53. Accordingly, the locking arm 66 is allowed to be elastically deformed. In the unlocked position, thus, the projection 79 of the lock ensuring member 54 allows the elastic deformation of the locking arm 66.

Figure 7:
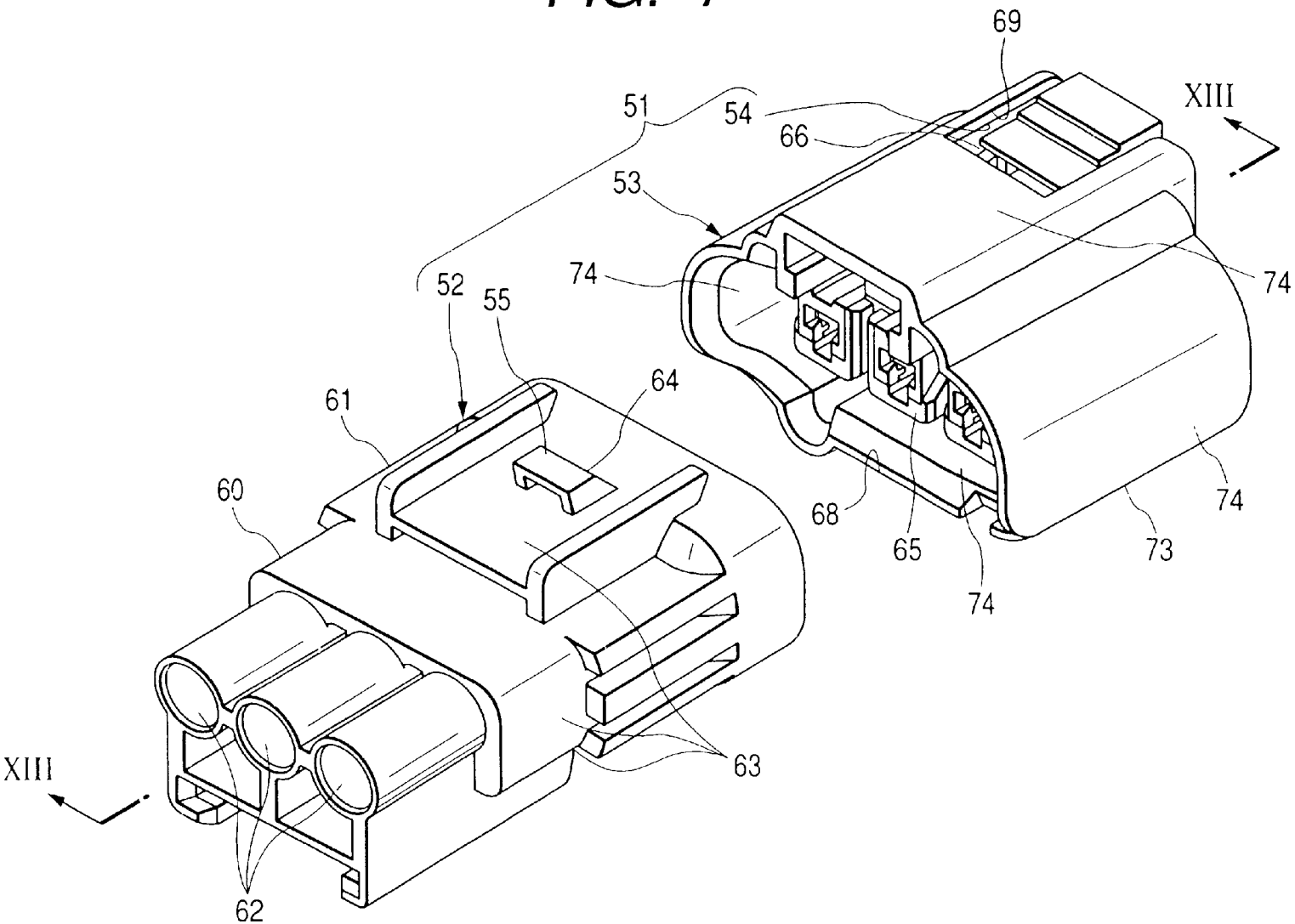
FIG. 7 is an exploded perspective view showing a connector provided with a lock ensuring mechanism according to a second embodiment of the invention.
Figure 8:
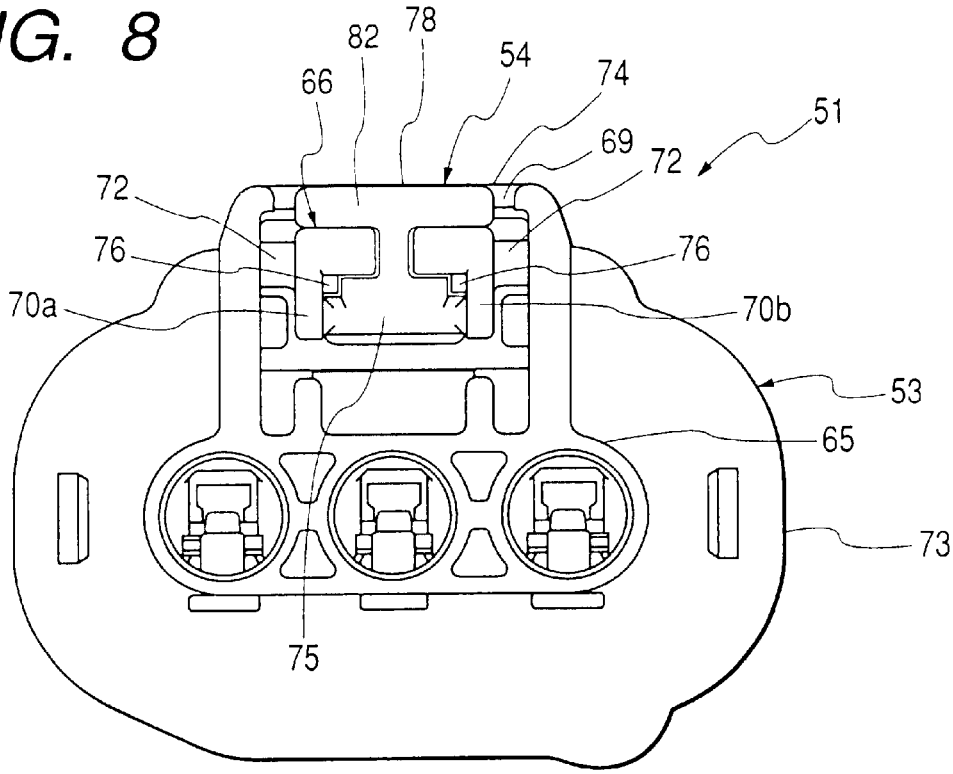
FIG. 8 is a front view showing a male housing in a state in which a lock ensuring member of the connector in FIG. 7 is placed in a locked position.

When the connector 51 having a lock ensuring mechanism which is constituted as described above is to be assembled, it is desirable that the lock ensuring member 54 should be placed in the locked position shown in FIG. 8 before the male housing 53 is engaged with the female housing 52. When the female housing 52 and the male housing 53 are to be engaged with each other, first of all, the opening of the hood portion 61 is opposed to the opening 68 of the hood portion 73 as shown in FIGS. 7 and 13. At this time, the opening of the hood portion 61 is opposed to the main body 65.

Figure 14:
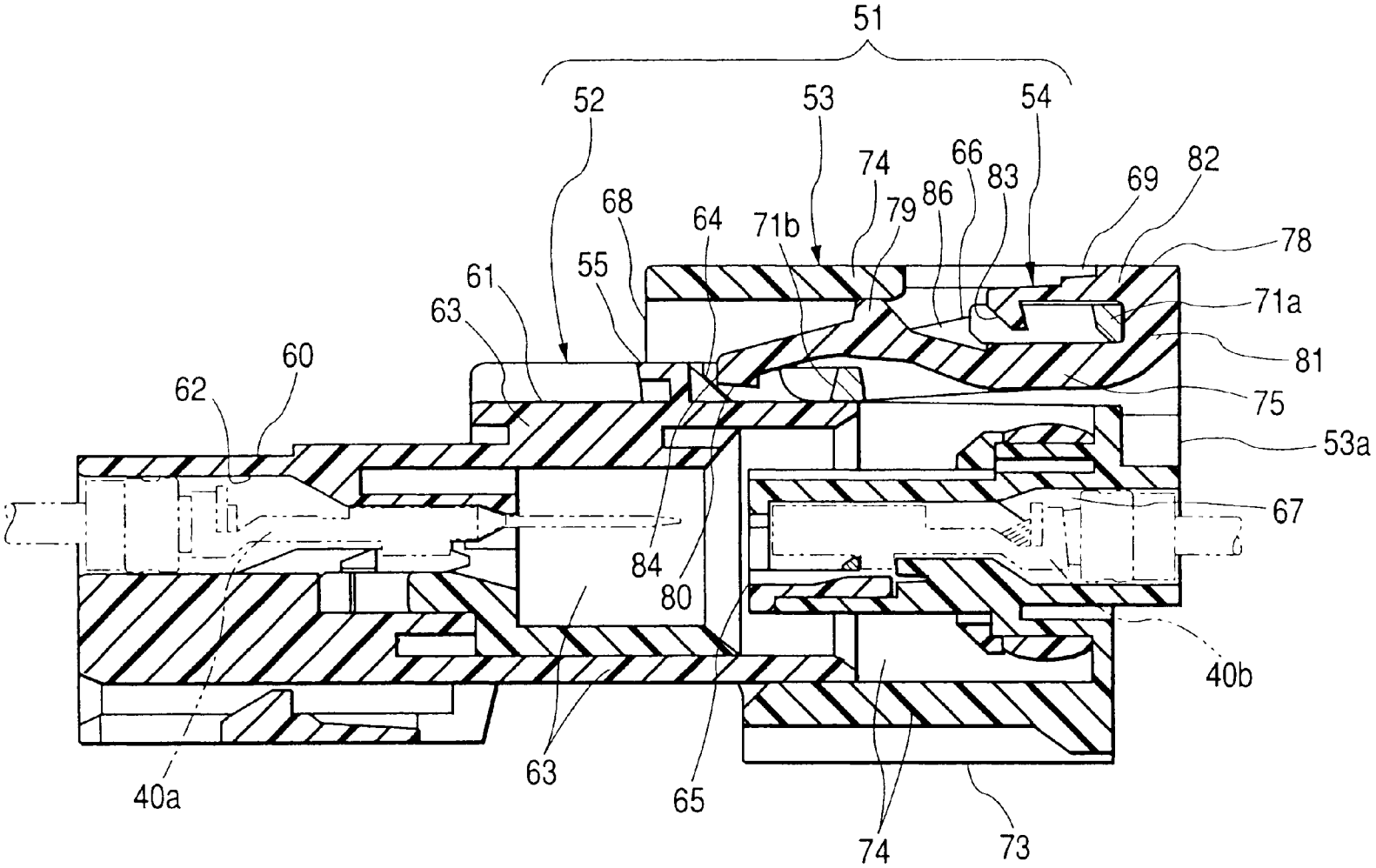
FIG. 14 is a sectional view showing a state in which female and male housings in FIG. 7 are started to be engaged with each other.

Then, the main body 65 is gradually inserted into the hood portion 61 and the female housing 52 is gradually inserted into the hood portion 73. As shown in FIG. 14, consequently, the tapered face 64 of the locking projection 55 abuts on the contact face 84 of the lock ensuring member 54, that is, the abutment portion 80.

Figure 9:
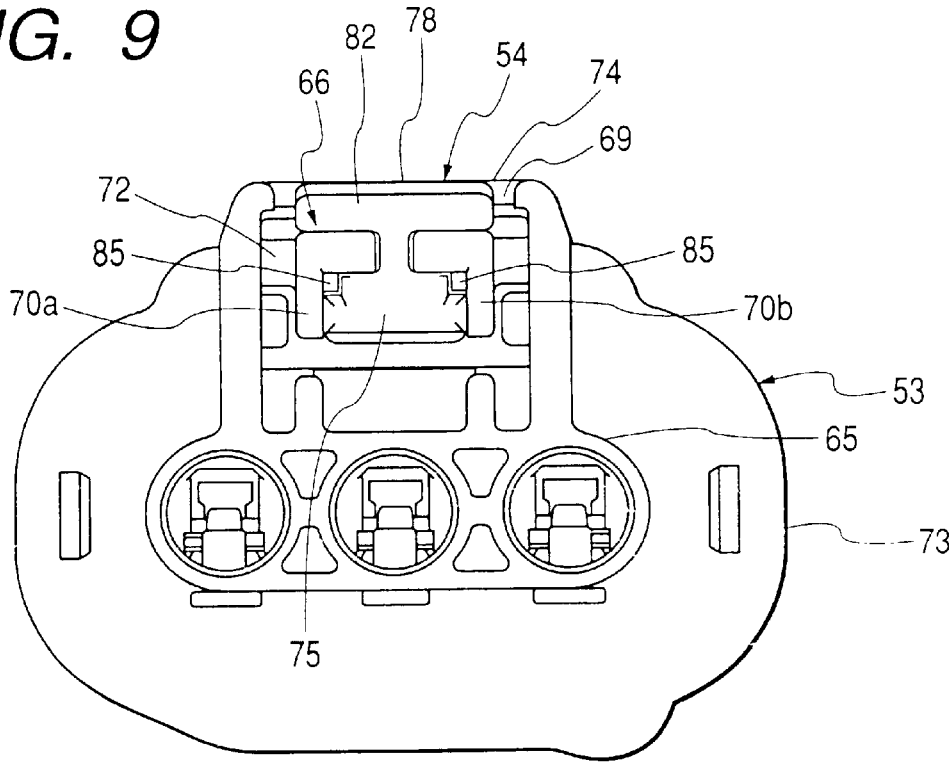
FIG. 9 is a front view showing the male housing in a state in which the lock ensuring member of the connector in FIG. 7 is placed in an unlocked position.
Figure 15:
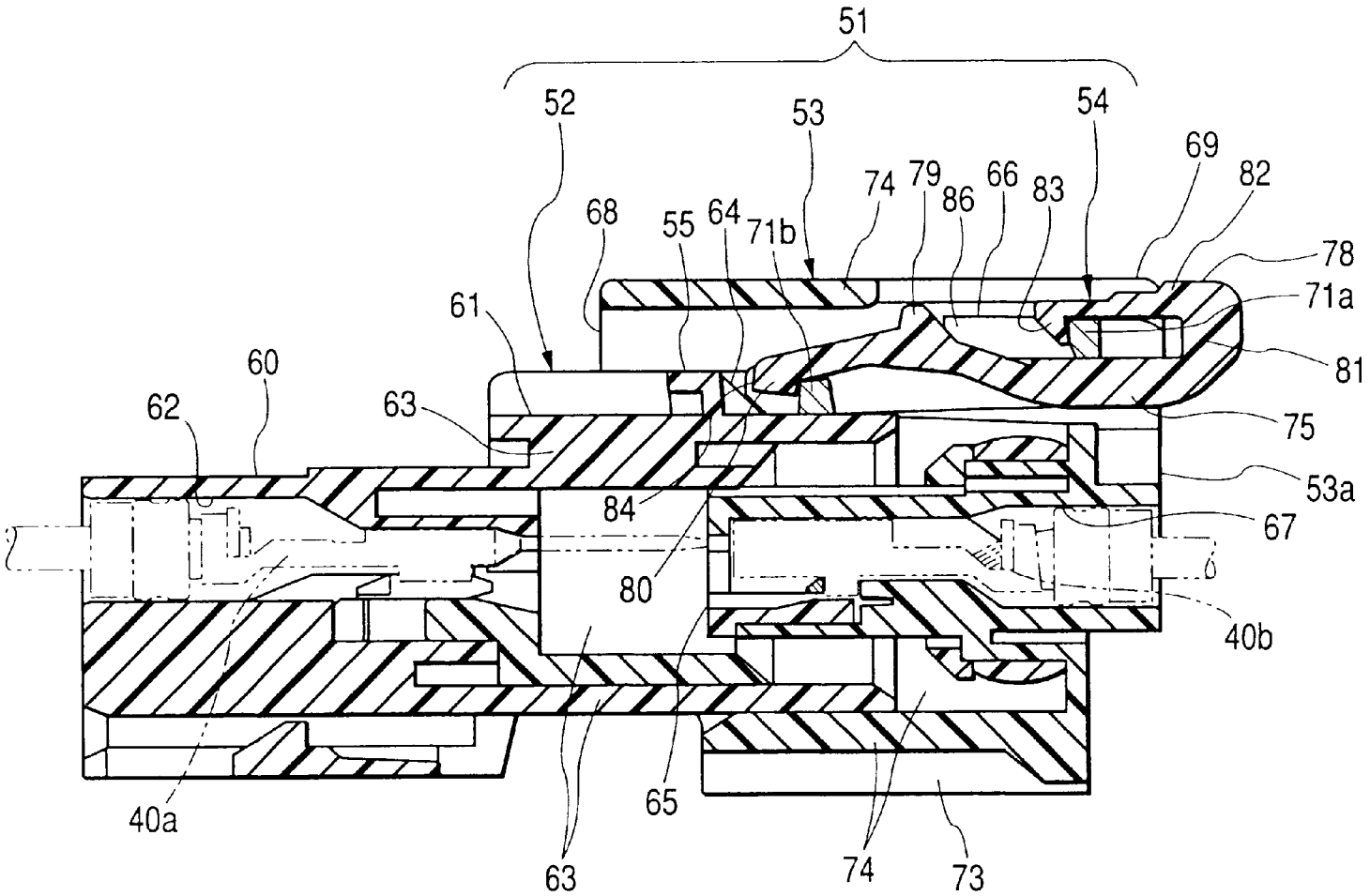
FIG. 15 is a sectional view showing a state in which the lock ensuring member is displaced to the unlocked position from the state shown in FIG. 14.

Furthermore, when the main body 65 is inserted into the hood portion 61 and the female housing 52 is inserted into the hood portion 73, the lock ensuring member 54 slides toward the unlocked position because the projection 79 is opposed to the inner face of the peripheral wall 74. Then, the locking arm 66 is elastically deformed in such a direction that the spacing between the first rod members 70*a* and 70*b* is once enlarged, and the claw 76 goes beyond the convex portion 85 so that the lock ensuring member 54 is displaced to the unlocked position as shown in FIGS. 15 and 9. Thus, the projection 79 is exposed through the cutout 69. The locking arm 66 becomes elastically deformable.

Figure 16:
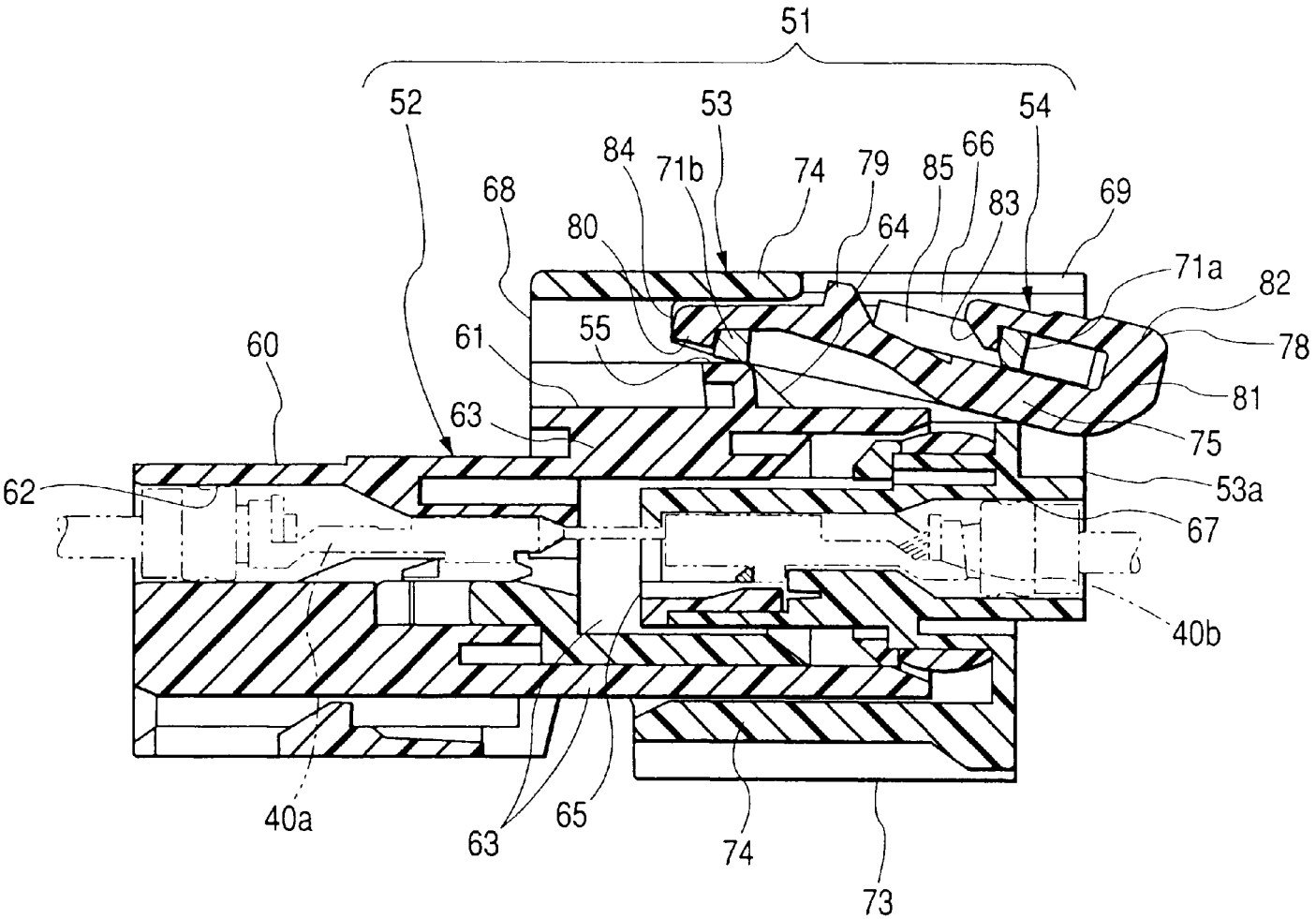
FIG. 16 is a sectional view showing a state in which the lock ensuring member and the locking arm are elastically deformed from the state of FIG. 15.

Furthermore, when the main body 65 is inserted into the hood portion 61 and the female housing 52 is inserted into the hood portion 73, the abutment portion 80 and the second rod member 71*b* closer to the opening 68 are guided by the tapered face 64 and are displaced to the outside of the male housing 53. At this time, the main body 75 of the lock ensuring member 54 and the locking arm 66 are elastically deformed in such a direction that the abutment portion 80, that is, the leading end of the main body 75 and the second rod member 71*b* approach the peripheral wall 74. As shown in FIG. 16, the abutment portion 80 and the second rod member 71*b* ride over the locking projection 55.

Thus, the lock ensuring member 54 is moved in such a direction as to go away from the female housing 52 from the locked position toward the unlocked position until the locking arm 66 and the locking projection 55 are engaged with each other, when the female housing 52 and the male housing 53 are engaged with each other. At this time, the attachment portion 78 is protruded from the outer face 53*a* of the male housing 53 if the lock ensuring member 54 is placed in the unlocked position.

Figure 17:
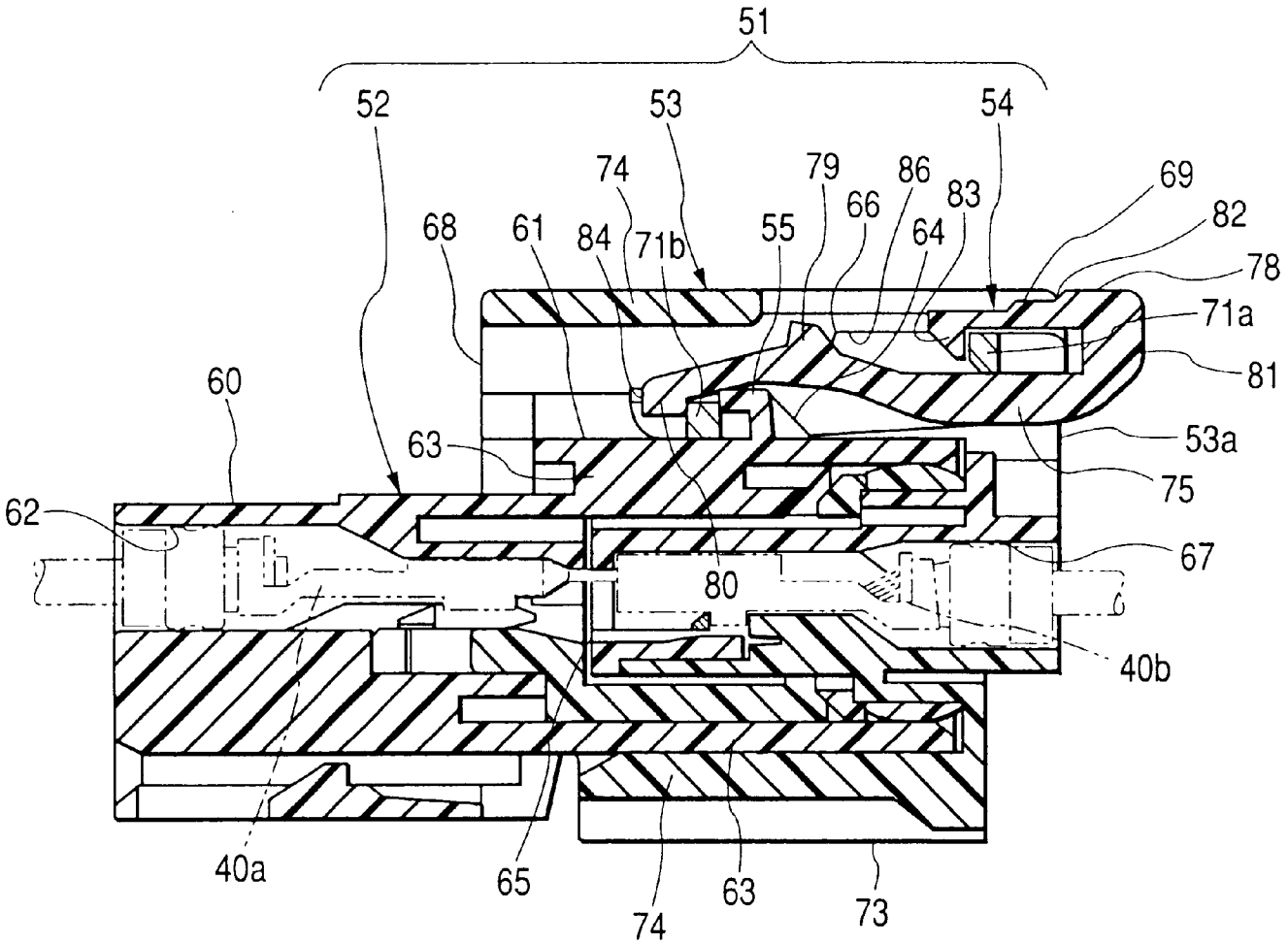
FIG. 17 is a sectional view showing a state in which a locking projection is engaged with a locking hole of the locking arm from the state of FIG. 16.

Furthermore, when the main body 65 is inserted into the hood portion 61 and the female housing 52 is inserted into the hood portion 73, the abutment portion 80 and the second rod member 71*b* ride over the locking projection 55 so that the locking projection 55 gets into the locking hole 86. When the locking projection 55 gets into the locking hole 86, the locking projection 55 is engaged with the locking hole 86 as shown in FIG. 17 by the elastic restoring force of the locking arm 66 and the main body 75.

Figure 18:
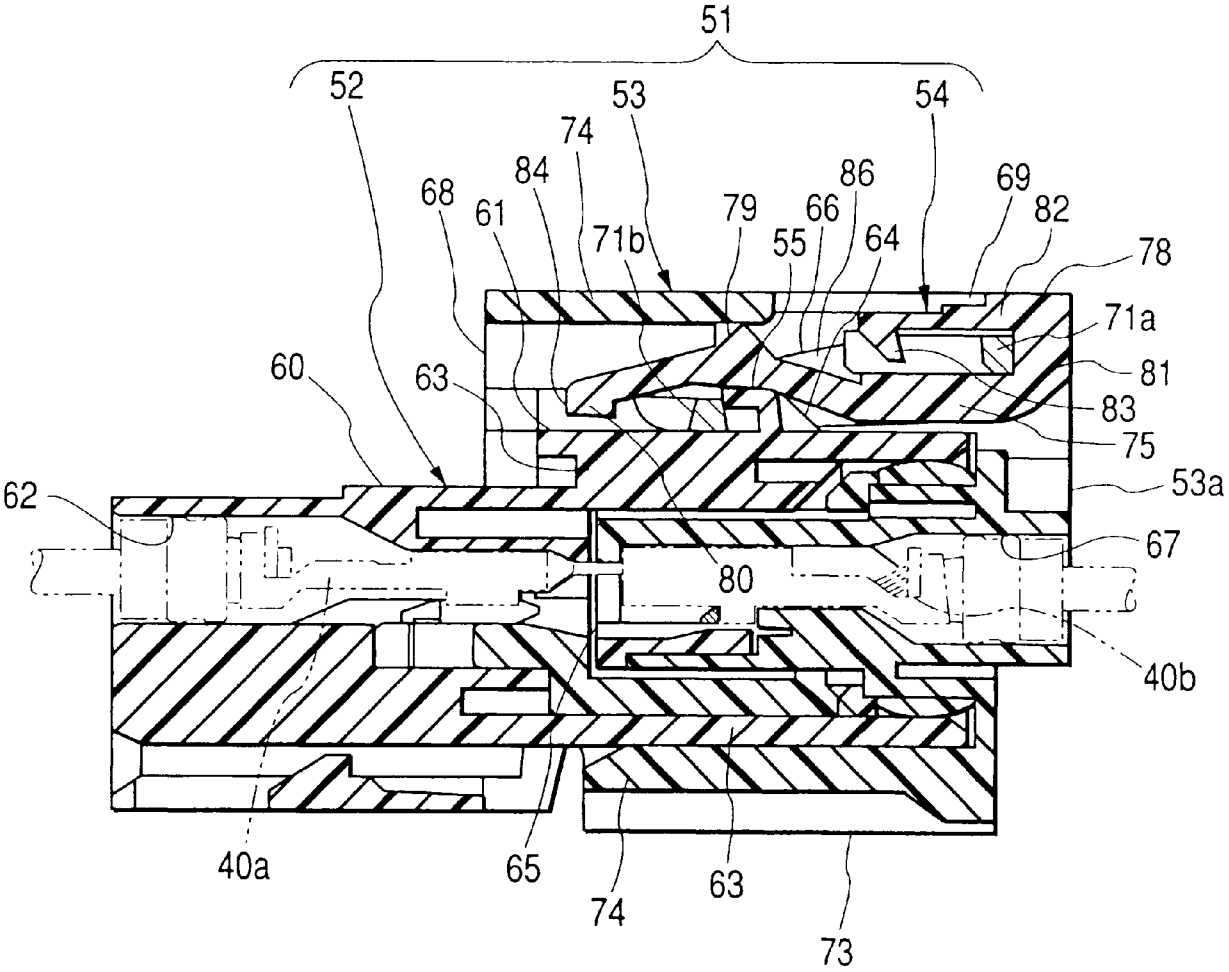
FIG. 18 is a sectional view showing a state in which the lock ensuring member is displaced to the locked position from the state of FIG. 17.

Thus, when the male housing 53 is engaged with the female housing 52 in such a state that the lock ensuring member 54 is placed in the locked position, the lock ensuring member 54 is displaced to the unlocked position. Then, the lock ensuring member 54 is moved toward the female housing 52. Consequently, the locking arm 66 is once deformed elastically in such a direction that the spacing between the first rod members 70*a* and 70*b* is enlarged. Then, the lock ensuring member 54 is placed in the locked position as shown in FIG. 18. The male housing 53 is engaged with the female housing 52 so that the male terminal 40*a* and the female terminal 40*b* are electrically connected to each other.

When the female housing 2 and male housing 3 thus fitted are to be removed, first of all, the lock ensuring member 54 is moved from the locked position toward the unlocked position. Then, the attachment portion 78 is pushed downward in FIG. 17 to elastically deform the locking arm 66 and the lock ensuring member 54, thereby keeping the second rod member 71*b* and the abutment portion 80 away from the peripheral wall 63 of the female housing 52. Then, the locking projection 55 is caused to slip out of the locking hole 86. Subsequently, the female housing 52 and the male housing 53 are moved apart from each other and are removed from each other.

Moreover, in the case in which the female housing 52 and the male housing 53 are set in a semiengaged state, that is, in such a state that the abutment portion 80 and the second rod member 71*b* ride over the locking projection 55 so that the locking projection 55 is not engaged with the locking hole 86 as shown in FIG. 16, the projection 79 comes in contact with the edge of the cutout 69 so that the lock ensuring member 54 cannot be moved toward the locked position. In such a state that the locking arm 66 is elastically deformed, the projection 79 maintains the lock ensuring member 54 in the unlocked position. By ascertaining whether or not the lock ensuring member 54 can be moved toward the locked position, thus, it is possible to recognize that the housings 52 and 53 can reliably be engaged or not.

In such a state that the housings 52 and 53 are engaged with each other, furthermore, the projection 79 of the lock ensuring member 54 is opposed to or comes in contact with the inner face of the peripheral wall 74 of the male housing 53. The projection 79 restricts the deformation of the main body 75 and the locking arm 66 in such a direction that the locking projection 55 is disengaged from the locking arm 66. For this reason, even if the housings 52 and 53 are to be separated from each other in such a state that the lock ensuring member 54 is placed in the locked position and the housings 52 and 53 are engaged with each other, the locking projection 55 is maintained to be engaged with the locking hole 86. Accordingly, when the lock ensuring member 54 is placed in the locked position, the housings 52 and. 53 engaged with each other are not accidentally removed from each other.

Furthermore, when the lock ensuring member 54 placed in the locked position is moved in the disengaging direction, the projection 79 does not disturb the movement of the lock ensuring member 54. Therefore, the lock ensuring member 54 can be moved smoothly to the unlocked position. Accordingly, the housings 52 and 53 can easily be removed from each other by moving the lock ensuring member 54 from the locked position to the unlocked position.

According to the embodiment, when the male housing 53 is to be engaged with the female housing 52, the lock ensuring member 54 is displaced from the locked position to the unlocked position. Consequently, an operator can easily recognize the lock ensuring member 54. Therefore, the operator hardly forgets to displace the lock ensuring member 54 toward the locked position. Accordingly, it is possible to reliably prevent the female housing 52 and the male housing 53 from accidentally slipping off after the engagement.

By confirming the position of the lock ensuring member 54, moreover, it is possible to reliably recognize that the locking arm 66 is engaged with the locking projection 55 or not. Accordingly, it is possible to more reliably prevent the female housing 52 and the male housing 53 from accidentally slipping off after the engagement.

Furthermore, when the female housing 52 and the male housing 53 are to be engaged with each other, the attachment portion 78 of the lock ensuring member 54 is protruded outward from the outer face 53*a* of the male housing 53. Consequently, the operator can easily recognize the lock ensuring member 54. Therefore, the operator hardly forgets to displace the lock ensuring member 54 toward the locked position. Accordingly, it is possible to more reliably prevent the female housing 52 and the male housing 53 from accidentally slipping off after the engagement.

Moreover, the attachment portion 78 of the lock ensuring member 54 is protruded in the unlocked position. Consequently, the locking arm 66 is easily deformed elastically through the lock ensuring member 54 so that the locking arm 66 can easily be disengaged from the locking projection 55. Accordingly, the female housing 52 and the male housing 53 can easily be removed from each other.

A pair of claws 76 and a pair of convex portions 85 hold the position of the lock ensuring member 54. Consequently, the lock ensuring member 54 displaced to the locked position can be prevented from being displaced to the unlocked position after the female housing 52 and the male housing 53 are engaged with each other. Accordingly, it is possible to more reliably prevent the female housing 52 and the male housing 53 from accidentally slipping off after the engagement.

Moreover, the projection 79 comes in contact with the inner face of the peripheral wall 74 of the male housing 53 in the locked position such that the main body 75 of the lock ensuring member 54 and the locking arm 66 are not deformed elastically. In the locked position, thus, the projection 79 restricts the elastic deformation of the locking arm 66. Therefore, when the lock ensuring member 54 is placed in the locked position, the elastic deformation of the locking arm 66 is restricted. Consequently, it is possible to prevent the female housing 52 and the male housing 53 from accidentally slipping off.

In such a state that the locking arm 66 is elastically deformed, the projection 79 is liable to be protruded from the cutout 69. For this reason, the lock ensuring member 54 is maintained in the unlocked position by the projection 79 in such a state that the locking arm 66 is elastically deformed. Consequently, it is possible to recognize that the locking arm 66 and the locking projection 55 are completely engaged with each other or not, that is, the female housing 52 and the male housing 53 are completely engaged with each other or not.

While the locking projection 55 is provided in the female housing 52 and the lock ensuring member 54, the locking arm 66 and the locking hole 86 are provided in the male housing 53 in the second embodiment, the invention is not restricted thereto but it is a matter of course that the locking projection 55 may be provided in the male housing 53 and the lock ensuring member 54, the locking arm 66 and the locking hole 86 may be provided in the female housing 52.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A method of ensuring whether a first housing and a second housing which constitute a connector are completely engaged with each other, comprising the steps of:

providing a locking member in the first housing;

providing a locking arm in the second housing so as to be once deformed to be engaged with the locking member to engage the first housing and the second housing;

providing a lock ensuring member which is supported by the locking arm so as to be moveable with respect to the second housing in the extending direction of the locking arm between a first position toward the first housing and a second position away from the first housing, so as to restrict the deformation of the locking arm at the first position, so as to allow the deformation of the locking arm at the second position, and such that the lock ensuring member is moved toward the second position when the first housing and the second housing are moved to be completely engaged with each other;

starting an engaging operation of the first housing and the second housing in a state that the lock ensuring member is placed at the first position; and moving the lock ensuring member toward the first position after the engaging operation is completed.

2. A connector for electrically connecting a first terminal fitting and a second terminal fitting, comprising:

a first housing, formed with a first chamber for accommodating the first terminal fitting therein;

a second housing, formed with a second chamber for accommodating the second terminal fitting therein;

a locking member, provided in the first housing;

a locking arm, extending from an outer face of the second housing in an extending direction of the second chamber, the locking arm being deformable in a direction perpendicular to the extending direction of the second chamber; and a lock ensuring member, supported by the locking arm movably in the extending direction of the second chamber between a first position closer to the first housing and a second position farther from the first housing, the lock ensuring member restricting the deformation of the locking arm at the first position, and allowing the deformation of the locking arm at the second position, wherein the locking arm is once deformed when the locking arm is engaged with the locking member to engage the first housing and the second housing;

wherein the lock ensuring member is moved toward the second position until the locking arm is engaged wit the locking member;

wherein the second housing includes a stopper which delimits the movable range of the lock ensuring member toward the first housing, wherein the stopper is brought into contact with a first position of the lock ensuring member when the locking projection is engaged with the release stopper; and wherein a dimension between the stopper and a first outer face of the second housing which is most distant from the first housing is not less than a dimension obtained by adding a dimension between the first portion of the lock ensuring member and the first outer face of the second housing and a dimension in which the lock ensuring member moves toward the second position when the first housing and the second housing are engaged.

3. A connector for electrically connecting a first terminal fitting and a second terminal fitting, comprising:

a first housing, formed with a first chamber for accommodating the first terminal fitting therein;

a second housing, formed with a second chamber for accommodating the second terminal fitting therein;

a locking member, provided in the first housing;

a locking arm, extended from an outer face of the second housing in an extending direction of the second chamber, the locking arm being deformable in a direction perpendicular to the extending direction of the second chamber; and a lock ensuring member, supported by the locking arm movably in the extending direction of the second chamber between a first position closer to the first housing and a second position farther from the first housing, the lock ensuring member restricting the deformation of the locking arm at the first position, and allowing the deformation of the locking arm at the second position, wherein the locking arm is once deformed when the locking arm is engaged with the locking member to engage the first housing and the second housing;

wherein the lock ensuring member is moved toward the second position until the locking arm is engaged wit the locking member;

wherein the locking arm includes a locking projecting protruded in an outward direction of the second housing and the lock ensuring member includes: a release stopper; an abutment face; and a locking recess;

wherein the locking projection is engaged with the release stopper of the lock ensuring member or the locking member of the first housing;

wherein the abutment face is abutted against the first housing when the locking projection is engaged with the locking member;

wherein the locking projection is entered into the locking recess when the lock ensuring member is moved toward the second position; and wherein at least one of the lock ensuring member and the locking arm includes a guide face which displaces the release stopper so as to be disengaged from, the locking projection, when the first housing and the second housing approach in a state that the locking projection is entered into the locking recess.

4. The connector as set forth in claim 3, wherein the second housing includes a restricting projection which is abutted against the lock ensuring member such that the release stopper is disengaged from the locking projection, when the locking arm is engaged with the locking member.

5. A connector for electrically connecting a first terminal fitting and a second terminal fitting, comprising:

a first housing, formed with a first chamber for accommodating the first terminal fitting therein;

a second housing, formed with a second chamber for accommodating the second terminal fitting therein;

a locking member, provided in the first housing;

a locking arm, extended from an outer face of the second housing in an extending direction of the second chamber, the locking arm being deformable in a direction perpendicular to the extending direction of the second chamber; and a lock ensuring member, supported by the locking arm and moveable with respect to the second housing in the extending direction of the second chamber between a first position toward the first housing and a second position away from the first housing, the lock ensuring member restricting the deformation of the locking arm at the first position, and allowing the deformation of the locking arm at the second position, wherein with the lock ensuring member in the second position, the locking arm is deformed when the locking arm is engaged with the locking member to engage the first housing and the second housing; and wherein the lock ensuring member is moved toward the second position when the first housing and the second housing are moved to be engaged with each other, and the lock ensuring member is moved toward the first position after the locking arm is engaged with the locking member.

6. The connector as set forth in claim 5, wherein one end portion of the lock ensuring member which is away from the first housing is not protruded from an outer face of the second housing, when the lock ensuring member is placed at the second position.

7. The connector as set forth in claim 5, wherein the second housing includes a stopper which delimits the movable range of the lock ensuring member toward the first housing.

8. The connector as set forth in claim 5, wherein one end portion of the lock ensuring member which is away from the first housing is protruded from an outer face of the second housing, when the lock ensuring member is placed at the second position.

9. The connector as set forth in claim 5, wherein the lock ensuring member includes a projection which restricts the deformation of the locking arm when the first housing and the second housing are engaged with each other in a state that the lock ensuring member is placed in the first position.

10. The connector as set forth in claim 5, wherein the lock ensuring member includes a projection which retains the lock ensuring member at the second position if thc locking arm is deformed when the first housing and the second housing are engaged with each other.

11. The connector as set forth in claim 5, further comprising:

a position retainer, which retains the lock ensuring member at either one of the first position and the second position.

12. The connector as set forth in claim 11, wherein the position retainer includes a deformable claw with which the lock ensuring member is provided, and a convex portion engaged with the position retainer, and the convex portion with which the lock arm is provided, and wherein the claw is deformed along with a sliding face of the convex portion when the lock ensuring member is moved between the first position and the second position.

* * * * *